US011007773B2

(12) United States Patent
Nakagawa et al.

(10) Patent No.: US 11,007,773 B2
(45) Date of Patent: May 18, 2021

(54) LIQUID EJECTION HEAD, LIQUID EJECTION MODULE, AND LIQUID EJECTION APPARATUS

(71) Applicant: CANON KABUSHIKI KAISHA, Tokyo (JP)

(72) Inventors: Yoshiyuki Nakagawa, Kawasaki (JP); Akiko Hammura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/526,285

(22) Filed: Jul. 30, 2019

(65) Prior Publication Data

US 2020/0039210 A1 Feb. 6, 2020

(30) Foreign Application Priority Data

Jul. 31, 2018 (JP) ..... JP2018-143894
Apr. 18, 2019 (JP) ..... JP2019-079683

(51) Int. Cl.
*B41J 2/015* (2006.01)
*B41J 2/045* (2006.01)
*B41J 2/14* (2006.01)

(52) U.S. Cl.
CPC ..... *B41J 2/045* (2013.01); *B41J 2/14233* (2013.01); *B41J 2002/14266* (2013.01)

(58) Field of Classification Search
CPC ..... B41J 2/14; B41J 2/211; B41J 2/1404
See application file for complete search history.

(56) References Cited

U.S. PATENT DOCUMENTS 6,151,049 A 11/2000 Karita et al.
6,217,157 B1 4/2001 Yoshihira et al.
6,331,050 B1 12/2001 Nakata et al.
6,431,688 B1 8/2002 Shin et al.
6,474,792 B2 11/2002 Sugiyama et al.
8,989,551 B2 * 3/2015 Yamazaki ..... H04N 5/44513 386/239
9,931,845 B2 4/2018 Moriya et al.
(Continued)

FOREIGN PATENT DOCUMENTS

CN 1243065 A 2/2000
CN 1338379 A 3/2002
(Continued)

OTHER PUBLICATIONS

U.S. Appl. No. 16/526,024, Yoshiyuki Nakagawa Akiko Hammura, filed Jul. 30, 2019.
(Continued)

*Primary Examiner* — Lam S Nguyen
(74) *Attorney, Agent, or Firm* — Venable LLP

(57) ABSTRACT

A first inflow port allows a first liquid to flow into a liquid flow passage, and a second inflow port allows a second liquid to flow into the liquid flow passage. The first and second liquids flow toward a pressure chamber. There is a portion satisfying L≥W, where L is a length of the first inflow port and W is a length of the liquid flow passage above the first inflow port, in a direction orthogonal to a direction of flow of the first liquid in the pressure chamber and to a direction of ejection of the second liquid from an ejection port. In a case where the second liquid is ejected from bottom to top, the second liquid flows above the first liquid.

20 Claims, 21 Drawing Sheets

(56) References Cited

U.S. PATENT DOCUMENTS

| | | | |
|---|---|---|---|
| 10,040,290 | B2 | 8/2018 | Okushima et al. |
| 10,300,707 | B2 | 5/2019 | Nakakubo et al. |
| 10,421,287 | B2 | 9/2019 | Yamazaki et al. |
| 2001/0015735 | A1* | 8/2001 | Matsumoto ..... B41J 2/04588 347/20 |
| 2002/0012026 | A1 | 1/2002 | Kubota et al. |
| 2005/0223847 | A1 | 10/2005 | Shiraishi et al. |
| 2006/0221104 | A1 | 10/2006 | Iwata et al. |
| 2010/0238232 | A1 | 9/2010 | Clarke et al. |
| 2013/0257994 | A1 | 10/2013 | Panchawagh et al. |
| 2014/0022313 | A1 | 1/2014 | Gao et al. |
| 2018/0370230 | A1 | 12/2018 | Nakagawa et al. |
| 2019/0001672 | A1 | 1/2019 | Hammura et al. |
| 2019/0009554 | A1 | 1/2019 | Nakagawa |
| 2019/0092011 | A1 | 3/2019 | Nakagawa et al. |

FOREIGN PATENT DOCUMENTS

| | | | |
|---|---|---|---|
| JP | 05-169663 | A | 7/1993 |
| JP | 06-305143 | A | 11/1994 |
| JP | 10-24565 | A | 1/1998 |
| JP | 2007-112099 | A | 5/2007 |
| WO | 2018/193446 | A1 | 10/2018 |

OTHER PUBLICATIONS

U.S. Appl. No. 16/526,054, Yoshiyuki Nakagawa Akiko Hammura, filed Jul. 30, 2019.

U.S. Appl. No. 16/526,312, Yoshiyuki Nakagawa Akiko Hammura, filed Jul. 30, 2019.

Extended European Search Report dated Nov. 28, 2019, in European Patent Application No. 19189003.7.

Office Action dated Nov. 30, 2020, in Indian Patent Application No. 201944030738.

Office Action dated Dec. 24, 2020, in Chinese Patent Application No. 201910693928.5.

* cited by examiner

LIQUID EJECTION HEAD, LIQUID EJECTION MODULE, AND LIQUID EJECTION APPARATUS

BACKGROUND OF THE INVENTION

Field of the Invention

This disclosure is related to a liquid ejection head, a liquid ejection module, and a liquid ejection apparatus.

DESCRIPTION OF THE RELATED ART

Japanese Patent Laid-Open No. H06-305143 (1994) discloses a configuration to retain a liquid serving as an ejection medium and a liquid serving as a bubbling medium in a state separated from each other with an interface defined therebetween inside a liquid flow passage that communicates with an ejection port, and to cause the bubbling medium to generate a bubble by using a heat generation element, thus ejecting the ejection medium from the ejection port.

SUMMARY OF THE INVENTION

In the first aspect of this disclosure, there is provided a liquid ejection head comprising:

a substrate;

a liquid flow passage formed on the substrate and configured to allow a first liquid and a second liquid to flow inside, the liquid flow passage including a pressure chamber;

a pressure generation element configured to apply pressure to the first liquid in the pressure chamber; and an ejection port configured to eject the second liquid, wherein the substrate includes a first inflow port configured to allow the first liquid to flow into the liquid flow passage in a direction crossing the liquid flow passage, and a second inflow port configured to allow the second liquid to flow into the liquid flow passage, the first inflow port is located at a position closer to the pressure chamber than the second inflow port is, the first liquid and the second liquid flowing into the liquid flow passage flow in the liquid flow passage toward the pressure chamber, in a case where a length of the first inflow port is defined as L and a length of the liquid flow passage above the first inflow port is defined as W, in a direction orthogonal to a direction of flow of the first liquid in the pressure chamber and to a direction of ejection of the second liquid from the ejection port, the liquid ejection head includes a portion that satisfies a relation defined as $L \geq W$, and in a case where the direction of ejection of the second liquid is a direction from bottom to top, the second liquid flows above the first liquid.

In the second aspect of this disclosure, there is provided a liquid ejection module for constituting a liquid ejection head, wherein the liquid ejection head includes a substrate, a liquid flow passage formed on the substrate and configured to allow a first liquid and a second liquid to flow inside, the liquid flow passage including a pressure chamber, a pressure generation element configured to apply pressure to the first liquid in the pressure chamber, and an ejection port configured to eject the second liquid, the substrate includes a first inflow port configured to allow the first liquid to flow into the liquid flow passage in a direction crossing the liquid flow passage, and a second inflow port configured to allow the second liquid to flow into the liquid flow passage, the first inflow port is located at a position closer to the pressure chamber than the second inflow port is, the first liquid and the second liquid flowing into the liquid flow passage flow in the liquid flow passage toward the pressure chamber, in a case where a length of the first inflow port is defined as L and a length of the liquid flow passage above the first inflow port is defined as W, in a direction orthogonal to a direction of flow of the first liquid in the pressure chamber and to a direction of ejection of the second liquid from the ejection port, the liquid ejection head includes a portion that satisfies a relation defined as $L \geq W$, in a case where the direction of ejection of the second liquid is a direction from bottom to top, the second liquid flows above the first liquid, and the liquid ejection head is formed by arraying the multiple liquid ejection modules.

In the third aspect of this disclosure, there is provided a liquid ejection apparatus comprising a liquid ejection head:

the liquid ejection head including a substrate, a liquid flow passage formed on the substrate and configured to allow a first liquid and a second liquid to flow inside, the liquid flow passage including a pressure chamber, a pressure generation element configured to apply pressure to the first liquid in the pressure chamber, and an ejection port configured to eject the second liquid, wherein the substrate includes a first inflow port configured to allow the first liquid to flow into the liquid flow passage in a direction crossing the liquid flow passage, and a second inflow port configured to allow the second liquid to flow into the liquid flow passage, the first inflow port is located at a position closer to the pressure chamber than the second inflow port is, the first liquid and the second liquid flowing into the liquid flow passage flow in the liquid flow passage toward the pressure chamber, in a case where a length of the first inflow port is defined as L and a length of the liquid flow passage above the first inflow port is defined as W, in a direction orthogonal to a direction of flow of the first liquid in the pressure chamber and to a direction of ejection of the second liquid from the ejection port, the liquid ejection head includes a portion that satisfies a relation defined as $L \geq W$, and in a case where the direction of ejection of the second liquid is a direction from bottom to top, the second liquid flows above the first liquid.

According to an embodiment of this disclosure, it is possible to stabilize a liquid ejection performance by arranging a first liquid and a second liquid in a height direction of a liquid flow passage.

Further features of the present invention will become apparent from the following description of exemplary embodiments with reference to the attached drawings.

DESCRIPTION OF THE EMBODIMENTS

Nonetheless, Japanese Patent Laid-Open No. H06-305143 (1994) lacks a detailed description of a shape of an inflow portion for a liquid to a liquid flow passage. According to the investigations conducted by the persons involved in this disclosure, aspects of the interface significantly vary depending on the shape of the inflow portion. For instance, depending on the shape of the inflow portion, the interface may be formed such that the first liquid and the second liquid are arranged in a height direction of the liquid flow passage (a pressure chamber) or the interface may be formed such that the first liquid and the second liquid are arranged in a width direction of the liquid flow passage (the pressure chamber).

The embodiments of this disclosure stabilize ejection performances of the liquids by arranging the first liquid and the second liquid in the height direction of the liquid flow passage and of the pressure chamber.

Now, embodiments of this disclosure will be described with reference to the drawings.

First Embodiment (Configuration of Liquid Ejection Head)

Figure 1:
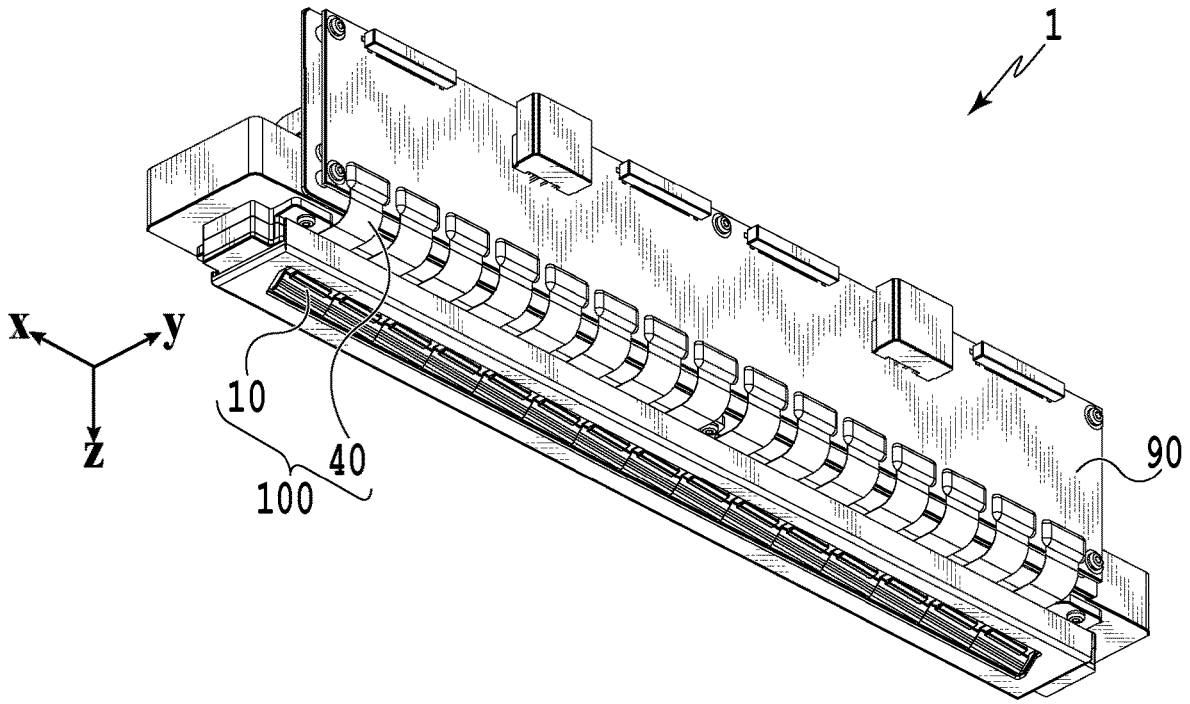
FIG. 1 is a perspective view of an ejection head of a first embodiment.

FIG. 1 is a perspective view of a liquid ejection head 1 in this embodiment. The liquid ejection head 1 of this embodiment is formed by arranging multiple liquid ejection modules 100 (an array of modules) in an x direction. Each liquid ejection module 100 includes an element board 10 on which ejection elements are arranged, and a flexible wiring board 40 for supplying electric power and ejection signals to the respective ejection elements. The flexible wiring boards 40 are connected to an electric wiring board 90 used in common, which is provided with arrays of power supply terminals and ejection signal input terminals. Each liquid ejection module 100 is easily attachable to and detachable from the liquid ejection head 1. Accordingly, any desired liquid ejection module 100 can be easily attached from outside to or detached from the liquid ejection head 1 without having to disassemble the liquid ejection head 1.

Given the liquid ejection head 1 formed by the multiple arrangement of the liquid ejection modules 100 (by arranging multiple modules) in a longitudinal direction as described above, even if a certain one of the ejection elements causes an ejection failure, only the liquid ejection module involved in the ejection failure needs to be replaced. Thus, it is possible to improve a yield of the liquid ejection heads 1 during a manufacturing process thereof, and to reduce costs for replacing the head.

(Configuration of Liquid Ejection Apparatus)

Figure 2:
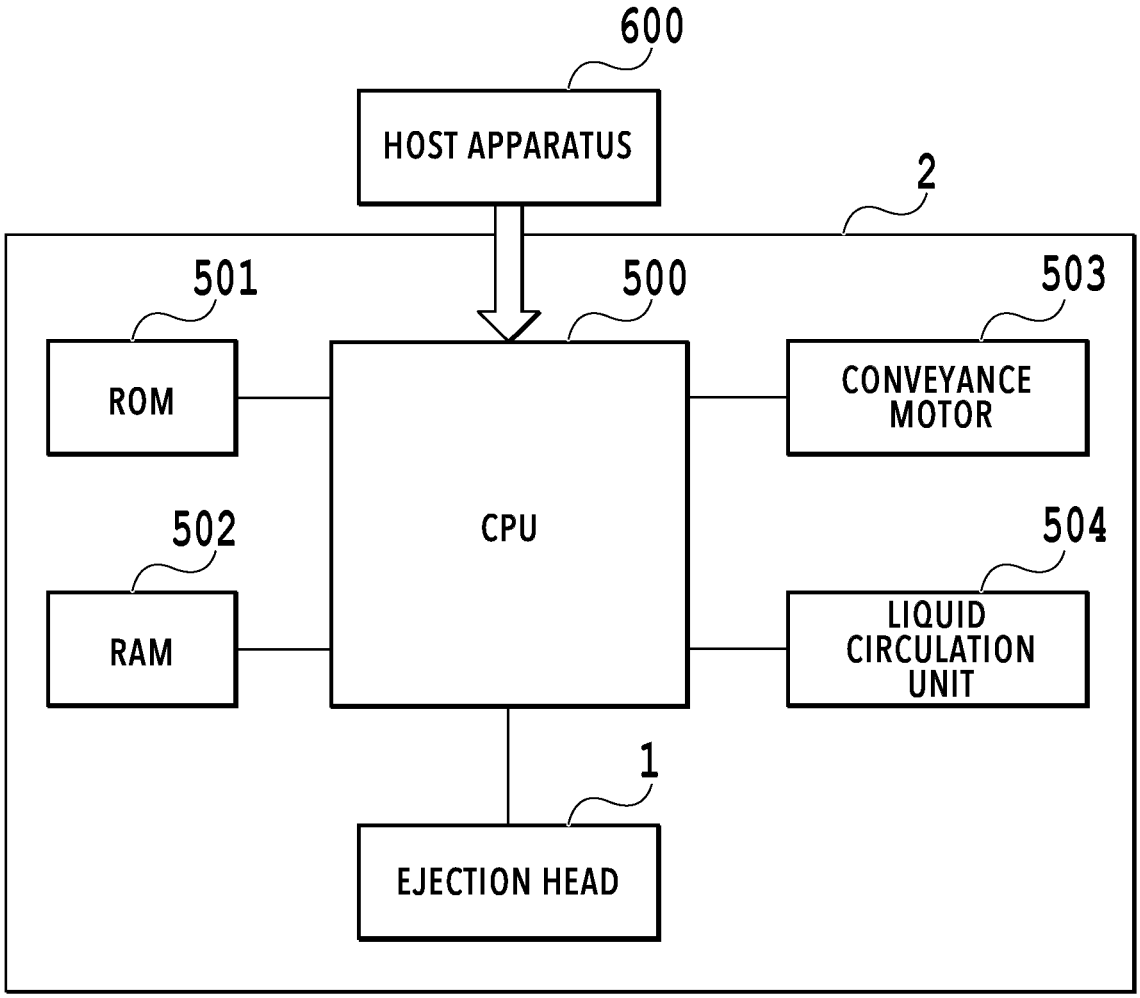
FIG. 2 is a block diagram of a control system of a liquid ejection apparatus of the first embodiment.

FIG. 2 is a block diagram showing a control configuration of a liquid ejection apparatus 2 usable in the embodiment of the present disclosure. A CPU 500 controls the entire liquid ejection apparatus 2 in accordance with programs stored in a ROM 501 while using a RAM 502 as a work area. The CPU 500 performs prescribed data processing in accordance with the programs and parameters stored in the ROM 501 on ejection data to be received from an externally connected host apparatus 600, for example, thereby generating the ejection signals for causing the liquid ejection head 1 to eject liquid. Then, the liquid ejection head 1 is driven in accordance with the ejection signals while a target medium for depositing the liquid is moved in a predetermined direction by driving a conveyance motor 503. Thus, the liquid ejected from the liquid ejection head 1 is deposited on the deposition target medium for adhesion. In the case where the liquid ejection apparatus 2 constitutes an inkjet printing apparatus, the liquid ejection head 1 serving as an inkjet printing head ejects inks while the conveyance motor 503 conveys a printing medium in order to move the printing medium relative to the liquid ejection head 1.

A liquid circulation unit 504 is a unit configured to circulate and supply the liquid to the liquid ejection head 1 and to conduct flow control of the liquid in the liquid ejection head 1. The liquid circulation unit 504 includes a sub-tank to store the liquid, a flow passage for circulating the liquid between the sub-tank and the liquid ejection head 1, pumps, a flow rate control unit for controlling a flow rate of the liquid flowing in the liquid ejection head 1, and so forth. Hence, under the instruction of the CPU 500, the liquid circulation unit 504 controls these mechanisms such that the liquid flows in the liquid ejection head 1 at a predetermined flow rate.

(Configuration of Element Board)

Figure 3:
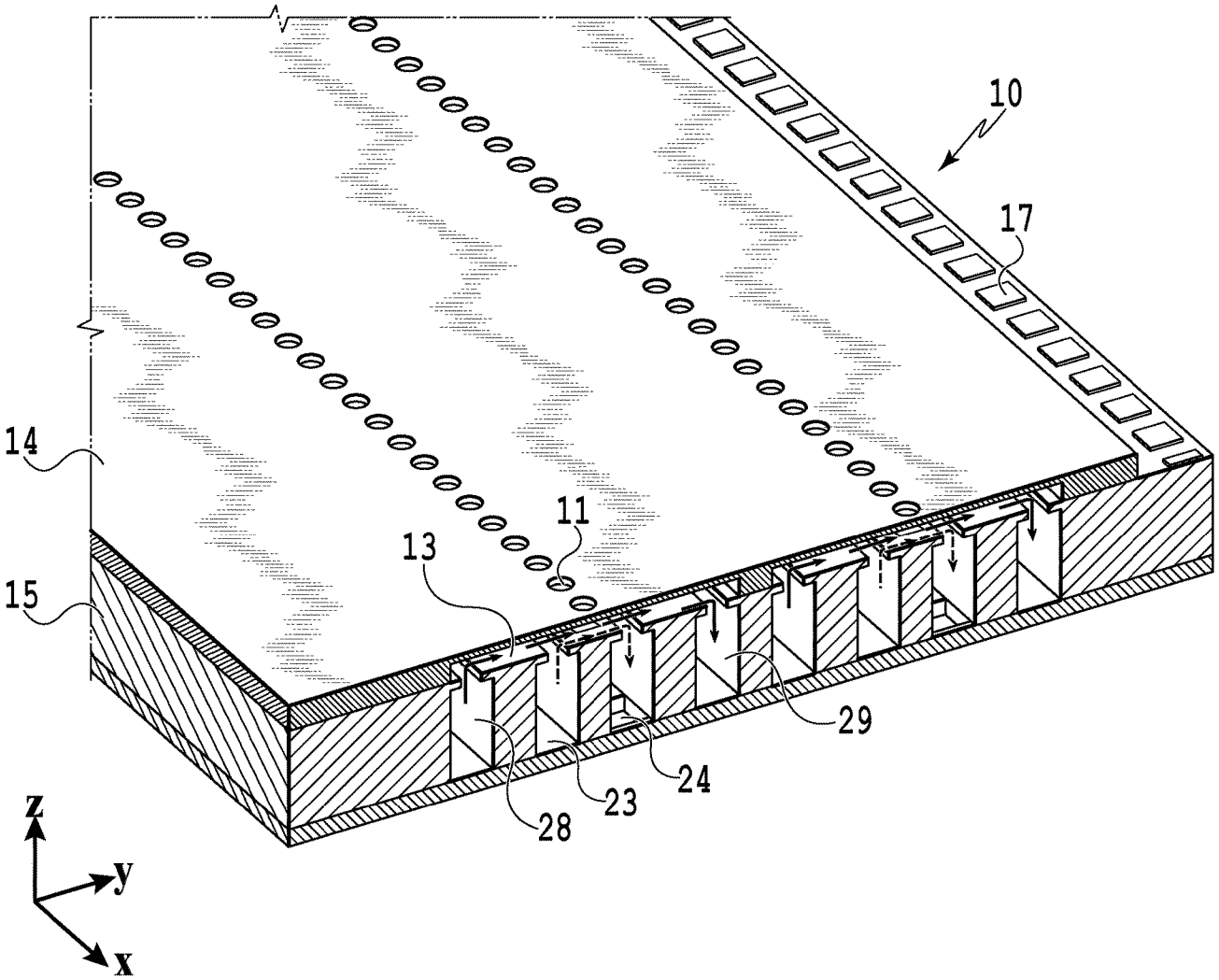
FIG. 3 is a cross-sectional perspective view of a liquid ejection module in FIG. 1.

FIG. 3 is a cross-sectional perspective view of the element board 10 provided in each liquid ejection module 100. The element board 10 is formed by stacking an orifice plate 14 on a silicon (Si) substrate 15. In the orifice plate 14 (ejection port forming member), arrays of multiple ejection ports 11 for ejecting liquid are formed in the x direction. In FIG. 3, ejection ports 11 arranged in the x direction eject the liquid of the same type (such as a liquid supplied from a common sub-tank and a common supply port). FIG. 3 illustrates an example in which the orifice plate 14 is also provided with liquid flow passages 13. Instead, the element board 10 may adopt a configuration in which the liquid flow passages 13 are formed by using a different component (a flow passage forming member) and the orifice plate 14 provided with the ejection ports 11 is placed thereon.

Pressure generation elements 12 (not shown in FIG. 3) are disposed, on the silicon substrate 15, at positions corresponding to the respective ejection ports 11. Each ejection port 11 and the corresponding pressure generation element 12 are located at such positions that are opposed to each other. In a case where a voltage is applied to the pressure generation element 12 in response to an ejection signal, the pressure generation element 12 applies a pressure to the liquid in a z direction orthogonal to a flow direction (a y direction) of the liquid. Accordingly, the liquid is ejected in the form of a droplet from the ejection port 11 opposed to the pressure generation element 12. The flexible wiring board 40 (see FIG. 1) supplies the electric power and driving signals to the pressure generation elements 12 via terminals 17 arranged on the silicon substrate 15. Although a silicon substrate is used as the substrate 15 in this case, the substrate may be formed from a different member. Meanwhile, if the substrate 15 is made of the silicon substrate, then an oxide film (layer), an insulating film (layer), and the like provided to the silicon substrate will be collectively referred to as the substrate (the silicon substrate).

The multiple liquid flow passages 13 which extend in the y direction and are connected respectively to the ejection ports 11 are formed between the silicon substrate 15 and the orifice plate 14 on the substrate (the silicon substrate 15). Liquids flowing in each of the liquid flow passages 13 includes a first liquid and a second liquid to be described later flow. The liquid flow passages 13 arranged in the x direction are connected to a first common supply flow passage 23, a first common collection flow passage 24, a second common supply flow passage 28, and a second common collection flow passage 29 in common. Flows of liquids in the first common supply flow passage 23, the first common collection flow passage 24, the second common supply flow passage 28, and the second common collection flow passage 29 are controlled by the liquid circulation unit 504 in FIG. 2. To be more precise, the pump is controlled such that the first liquid flowing from the first common supply flow passage 23 into the liquid flow passages 13 is directed to the first common collection flow passage 24 while the second liquid flowing from the second common supply flow passage 28 into the liquid flow passages 13 is directed to the second common collection flow passage 29.

FIG. 3 illustrates an example in which the ejection ports 11 and the liquid flow passages 13 arranged in the x direction, and the first and second common supply flow passages 23 and 28 as well as the first and second common collection flow passages 24 and 29 used in common for supplying and collecting inks to and from these ports and passages are defined as a set, and two sets of these constituents are arranged in the y direction.

(Configurations of Flow Passage and Pressure Chamber)

Figure 4A:
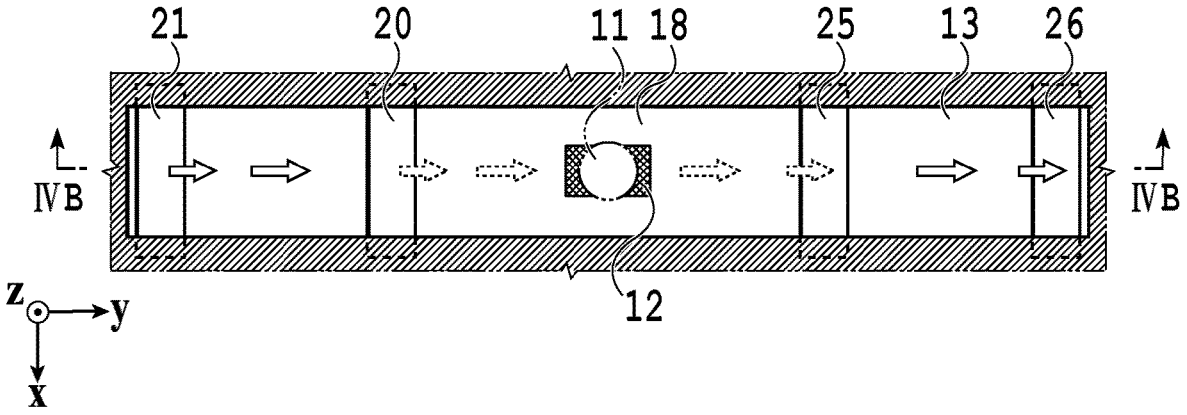
FIG. 4A is a transparent view of a liquid flow passage in an element board in FIGS. 3, and 4B is a cross-sectional view taken along the IVB-IVB line in FIG. 4A.
Figure 4B:
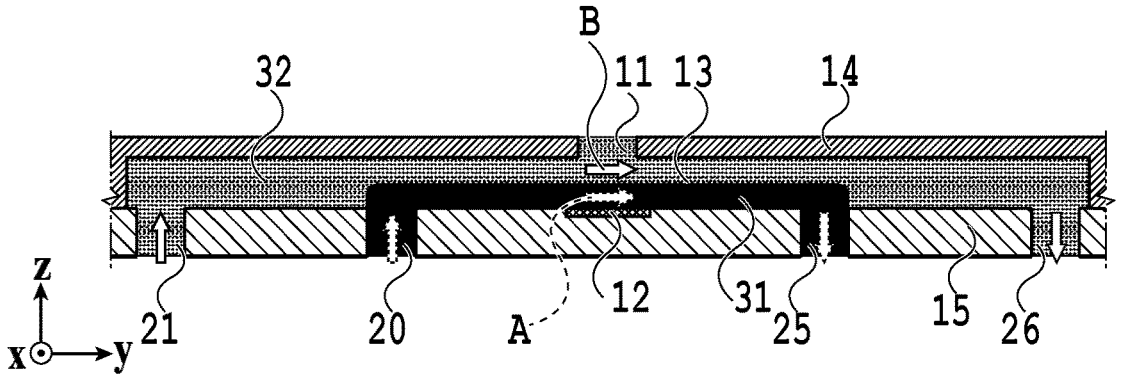
Figure 5A:
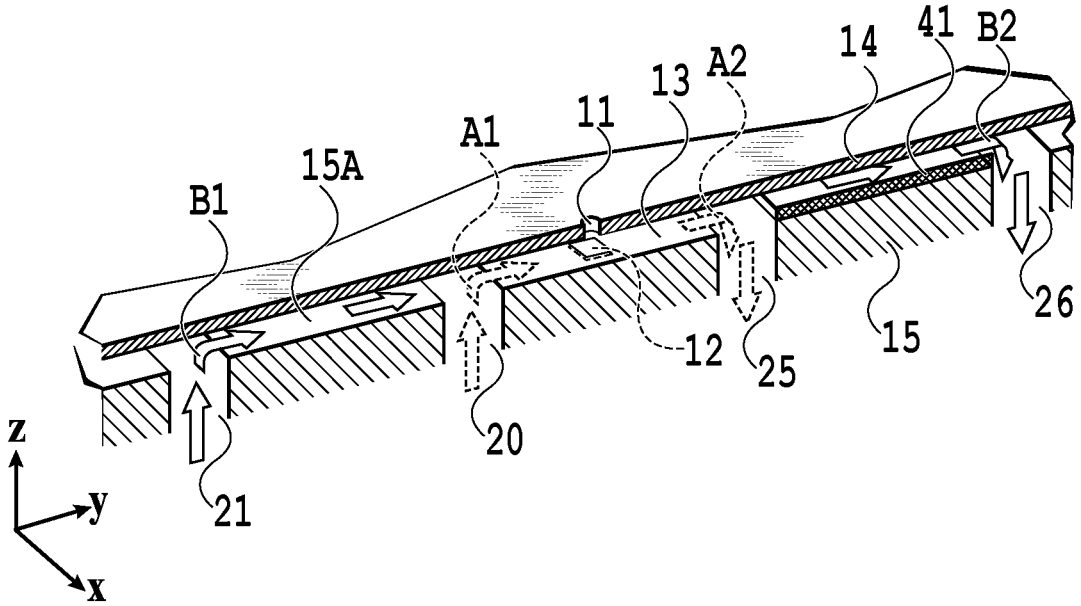
FIG. 5A is a perspective view of the liquid flow passage in FIGS. 4A, and 5B is an enlarged diagram of a portion near an ejection port in FIG. 4B.
Figure 5B:
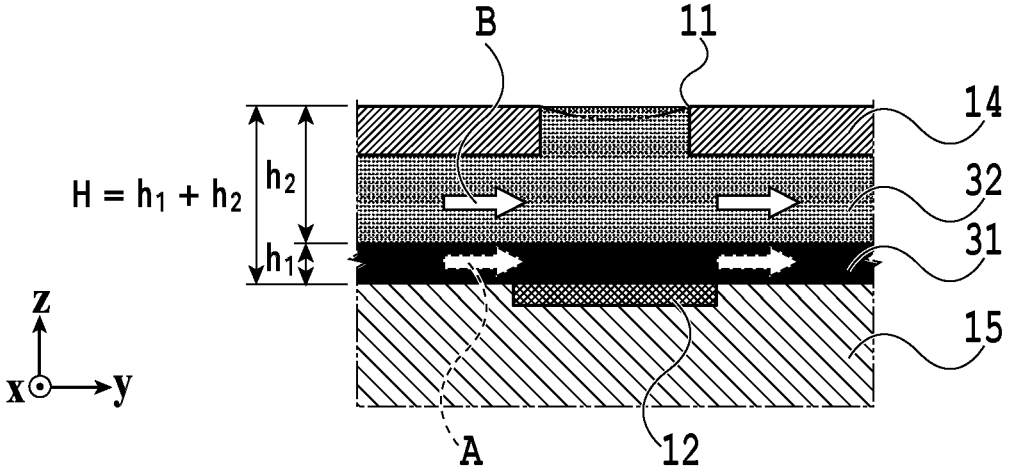

FIGS. 4A to 5B are diagrams for explaining detailed configurations of each liquid flow passage 13 and of each pressure chamber 18 formed in the element board 10. FIG. 4A is a perspective view from the ejection port 11 side (from a +z direction side) and FIG. 4B is a cross-sectional view taken along the IVB-IVB line shown in FIG. 4A. Meanwhile, FIG. 5A is a perspective view of the liquid flow passage 13 in FIG. 4A, and FIG. 5B is an enlarged diagram of the neighborhood of the ejection port 11 in FIG. 4B.

The silicon substrate 15 corresponding to a bottom portion (wall portion) of the liquid flow passage 13 includes a second inflow port 21, a first inflow port 20, a first outflow port 25, and a second outflow port 26, which are communicate with the liquid flow passage 13 and are formed in this order in the y direction. Moreover, the pressure chamber 18 including the ejection port 11 and the pressure generation element 12 is located substantially at the center between the first inflow port 20 and the first outflow port 25 in the liquid flow passage 13. The second inflow port 21 is connected to the second common supply flow passage 28, the first inflow port 20 is connected to the first common supply flow passage 23, the first outflow port 25 is connected to the first common collection flow passage 24, and the second outflow port 26 is connected to the second common collection flow passage 29 (see FIG. 3).

The first inflow port 20 causes the first liquid 31 to flow from an upstream side in a direction of flow of the liquid in the liquid flow passage 13 into the liquid flow passage 13 (to the inside of the liquid flow passage 13) in a direction crossing (which is orthogonal to in this example) the liquid flow passage 13. The first inflow port 20 is located at a position closer to the pressure chamber 18 than the second inflow port 21 is. The first liquid 31 supplied from the first common supply flow passage 23 through the first inflow port 20 flows into the liquid flow passage 13 as indicated with an arrow A1 and then flows inside the liquid flow passage 13 in the direction of arrows A. Specifically, the first liquid 31 flows in the liquid flow passage 13 toward the pressure chamber 18. Thereafter, the first liquid 31 passes through the pressure chamber 18 and flows out of the first outflow port 25 as indicated with an arrow A2. Then, the first liquid 31 is collected by the first common collection flow passage 24 (see FIG. 5A). The second inflow port 21 is located at a position upstream of the first inflow port 20 in the direction of flow of the liquid in the liquid flow passage 13 (on a side more remote from the pressure chamber 18 than the first inflow port 20 is). The second liquid 32 supplied from the second common supply flow passage 28 through the second inflow port 21 flows into the liquid flow passage 13 as indicated with an arrow B1 and then flows inside the liquid flow passage 13 in the direction of arrows B. Specifically, the second liquid 32 also flows in the liquid flow passage 13 toward the pressure chamber 18. Thereafter, the second liquid 32 passes through the pressure chamber 18 and flows out of the second outflow port 26 as indicated with an arrow B2. Then, the second liquid 32 is collected by the second common collection flow passage 29 (see FIG. 5A). Both of the first liquid 31 and the second liquid 32 flow in the y direction in a section of the liquid flow passage 13 between the first inflow port 20 and the first outflow port 25. In this instance, inside the pressure chamber 18, the first liquid 31 comes into contact with an inner surface of the pressure chamber 18 (a bottom surface on a lower side in FIG. 5B) of the pressure chamber 18 where the pressure generation element 12 is located. Meanwhile, the second liquid 32 forms a meniscus at the ejection port 11. The first liquid 31 and the second liquid 32 flow in the pressure chamber 18 such that the pressure generation element 12, the first liquid 31, the second liquid 32, and the ejection port 11 are arranged in this order. Specifically, assuming that the pressure generation element 12 is located on a lower side and the ejection port 11 is located on an upper side, the second liquid 32 flows above the first liquid 31 and these liquids are in contact with each other. The first liquid 31 and the second liquid 32 flow in a laminar state. Moreover, the first liquid 31 is pressurized by the pressure generation element 12 located below and at least the second liquid 32 is ejected upward from the bottom. Note that this up-down direction corresponds to a height direction of the pressure chamber 18 and of the liquid flow passage 13.

In this embodiment, a flow rate of the first liquid 31 and a flow rate of the second liquid 32 are adjusted in accordance with physical properties of the first liquid 31 and the second liquid 32 such that the first liquid 31 and the second liquid 32 flow in contact with each other in the pressure chamber as shown in FIG. 5B. Although the first and second liquids in the first embodiment and first, second and third liquids in a second embodiment to be described later form parallel flows flowing in the same direction, the embodiments are not limited to this mode. Specifically, in the first embodiment, the second liquid may flow in a direction opposite to the direction of flow of the first liquid. Alternatively, flow passages may be provided such that the flow of the first liquid crosses the flow of the second liquid. The same applies to the second embodiment to be described later.

In the following, the parallel flows among these modes will be described as an example.

In the case of the parallel flows, it is preferable to keep an interface between the first liquid 31 and the second liquid 32 from being disturbed, or in other words, to establish a state of laminar flows inside the pressure chamber 18 with the flows of the first liquid 31 and the second liquid 32. Specifically, in the case of an attempt to control an ejection performance so as to maintain a predetermined amount of ejection, it is preferable to drive the pressure generation element in a state where the interface is stable. Nevertheless, this embodiment is not limited only to this configuration. Even if the flow inside the pressure chamber 18 would transition to a state of turbulence whereby the interface between the two liquids would be somewhat disturbed, the pressure generation element 12 may still be driven in the case where it is possible to maintain the state where at least the first liquid flows mainly on the pressure generation element 12 side and the second liquid flows mainly on the ejection port 11 side. The following description will be mainly focused on the example where the flow inside the pressure chamber is in the state of parallel flows and in the state of laminar flows.

(Conditions to Form Parallel Flows in Concurrence with Laminar Flows)

Conditions to form laminar flows of liquids in a tube will be described to begin with. The Reynolds number Re to represent a ratio between viscous force and interfacial force has been generally known as a flow evaluation index.

Now, a density of a liquid is defined as ρ, a flow velocity thereof is defined as u, a representative length thereof is defined as d, a viscosity is defined as η. In this case, the Reynolds number Re can be expressed by the following (formula 1):

$$Re=\rho ud/\eta \quad \text{(formula 1).}$$

Here, it is known that the laminar flows are more likely to be formed as the Reynolds number Re becomes smaller. To be more precise, it is known that flows inside a circular tube are formed into laminar flows in the case where the Reynolds number Re is smaller than some 2200 and the flows inside the circular tube become turbulent flows in the case where the Reynolds number Re is larger than some 2200.

In the case where the flows are formed into the laminar flows, flow lines become parallel to a traveling direction of the flows without crossing each other. Accordingly, in the case where the two liquids in contact constitute the laminar flows, the liquids can form the parallel flows with the stable interface between the two liquids. Here, in view of a general inkjet printing head, a height H [μm] of the flow passage (the height of the pressure chamber) in the vicinity of the ejection port in the liquid flow passage (the pressure chamber) is in a range from about 10 to 100 μm. In this regard, in the case where water (density $\rho=1.0\times103$ kg/m$^3$, viscosity $\eta=1.0$ cP) is fed to the liquid flow passage of the inkjet printing head at a flow velocity of 100 mm/s, the Reynolds number Re turns out to be $Re=\rho ud/\eta\neq0.1\sim1.0<<2200$. As a consequence, the laminar flows can be deemed to be formed therein.

Here, even if the liquid flow passage 13 and the pressure chamber 18 of this embodiment have rectangular cross-sections as shown in FIG. 4A, the heights and widths of the liquid flow passage 13 and the pressure chamber 18 in the liquid ejection head are sufficiently small. For this reason, the liquid flow passage 13 and the pressure chamber 18 can be treated like in the case of the circular tube, or more specifically, the heights of the liquid flow passage 13 and the pressure chamber 18 can be treated as the diameter of the circular tube.

(Theoretical Conditions to Form Parallel Flows in State of Laminar Flows)

Next, conditions to form the parallel flows with the stable interface between the two types of liquids in the liquid flow passage 13 and the pressure chamber 18 will be described with reference to FIG. 5B. First, a distance from the silicon substrate 15 to an opening surface (ejection port surface) of the ejection port 11 of the orifice plate 14, that is, a height of the pressure chamber 18 is defined as H [μm]. Then a distance between the ejection port surface and an interface (liquid-liquid interface) between the first liquid 31 and the second liquid 32 (a phase thickness of the second liquid) is defined as $h_2$ [μm]. In addition, a distance between the interface and the silicon substrate 15 (a phase thickness of the first liquid) is defined as $h_1$ [μm]. These definitions bring about $H=h_1+h_2$.

As for boundary conditions in the liquid flow passage 13 and the pressure chamber 18, velocities of the liquids on wall surfaces of the liquid flow passage 13 and the pressure chamber 18 are assumed to be zero. Moreover, velocities and shear stresses of the first liquid 31 and the second liquid 32 at the interface are assumed to have continuity. Based on the assumption, if the first liquid 31 and the second liquid 32 form two-layered and parallel steady flows, then a quartic equation as defined in the following (formula 2) holds true in a section of the parallel flows:

[Mathematical 1]

$$(\eta_1-\eta_2)(\eta_1Q_1+\eta_2Q_2)h_1^4+2\eta_1H\{\eta_2(3Q_1+Q_2)-2\eta_1Q_1\}h_1^3+3\eta_1H^2\{2\eta_1Q_1-\eta_2(3Q_1+Q_2)\}h_1^2+4\eta_1Q_1H^3(\eta_2-\eta_1)h_1+\eta_1^2Q_1H^4=0 \quad \text{(formula 2)}$$

In the (formula 2), $\eta_1$ represents the viscosity of the first liquid 31, $\eta_2$ represents the viscosity of the second liquid 32, $Q_1$ represents the flow rate (volume flow rate [$um^3$/us]) of the first liquid 31, and $Q_2$ represents the flow rate (volume flow rate [$um^3$/us]) of the second liquid 32. In other words, the first liquid and the second liquid flow so as to establish a positional relationship in accordance with the flow rates and the viscosities of the respective liquids within such ranges to satisfy the above-mentioned quartic equation (formula 2), thereby forming the parallel flows with the stable interface. In this embodiment, it is preferable to form the parallel flows of the first liquid and the second liquid in the liquid flow passage 13 or at least in the pressure chamber 18. In the case where the parallel flows are formed as mentioned above, the first liquid and the second liquid are only involved in mixture due to molecular diffusion on the liquid-liquid interface therebetween, and the liquids flow in parallel in the y direction virtually without causing any mixture. Note that the flows of the liquids do not always have to establish the state of laminar flows in a certain region in the pressure chamber 18. In this context, it is preferable that at least the flows of the liquids in a region above the pressure generation element establish the state of laminar flows.

Even in the case of using immiscible solvents such as oil and water as the first liquid and the second liquid, for example, the stable parallel flows are formed regardless of the immiscibility as long as the (formula 2) is satisfied. Meanwhile, even in the case of oil and water, if the interface is disturbed due to a state of slight turbulence of the flow in the pressure chamber, it is preferable that at least the first liquid flow mainly on the pressure generation element and the second liquid flow mainly in the ejection port.

Figure 6A:
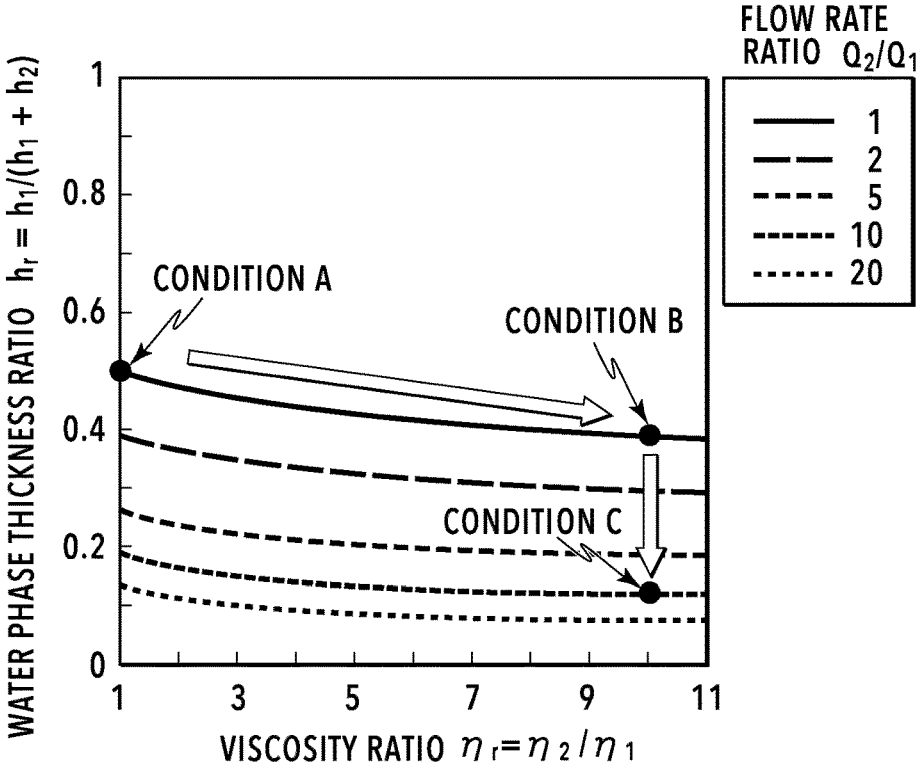
FIG. 6A is an explanatory diagram of relations between a viscosity ratio and a water phase thickness ratio of liquids.

FIG. 6A is a graph representing a relation between a viscosity ratio $\eta_r=\eta_2/\eta_1$ and a phase thickness ratio $h_r=h_1/(h_1+h_2)$ of the first liquid while changing a flow rate ratio $Q_r=Q_2/Q_1$ to several levels in (formula 2). Although the first liquid is not limited to water, the "phase thickness ratio of the first liquid" will be hereinafter referred to as a "water phase thickness ratio". The horizontal axis indicates the viscosity ratio $\eta_r=\eta_2/\eta_1$ and the vertical axis indicates the water phase thickness ratio $h_r=h_1/(h_1+h_2)$. The water phase thickness ratio $h_r$ becomes lower as the flow rate ratio $Q_r$ grows higher. Meanwhile, at each level of the flow rate ratio $Q_r$, the water phase thickness ratio $h_r$ becomes lower as the viscosity ratio $\eta_r$ grows higher. Therefore, the water phase thickness ratio $h_r$ (corresponding to the position of the interface between the first liquid and the second liquid) in the liquid flow passage 13 (the pressure chamber) can be adjusted to a prescribed value by controlling the viscosity ratio $h_r$ and the flow rate ratio $Q_r$ between the first liquid and the second liquid. In addition, in the case where the viscosity ratio $\eta_r$ is compared with the flow rate ratio $Q_r$, FIG. 6A teaches that the flow rate ratio $Q_r$ has a larger impact on the water phase thickness ratio $h_r$ than the viscosity ratio $\eta_r$ does.

Figure 6B:
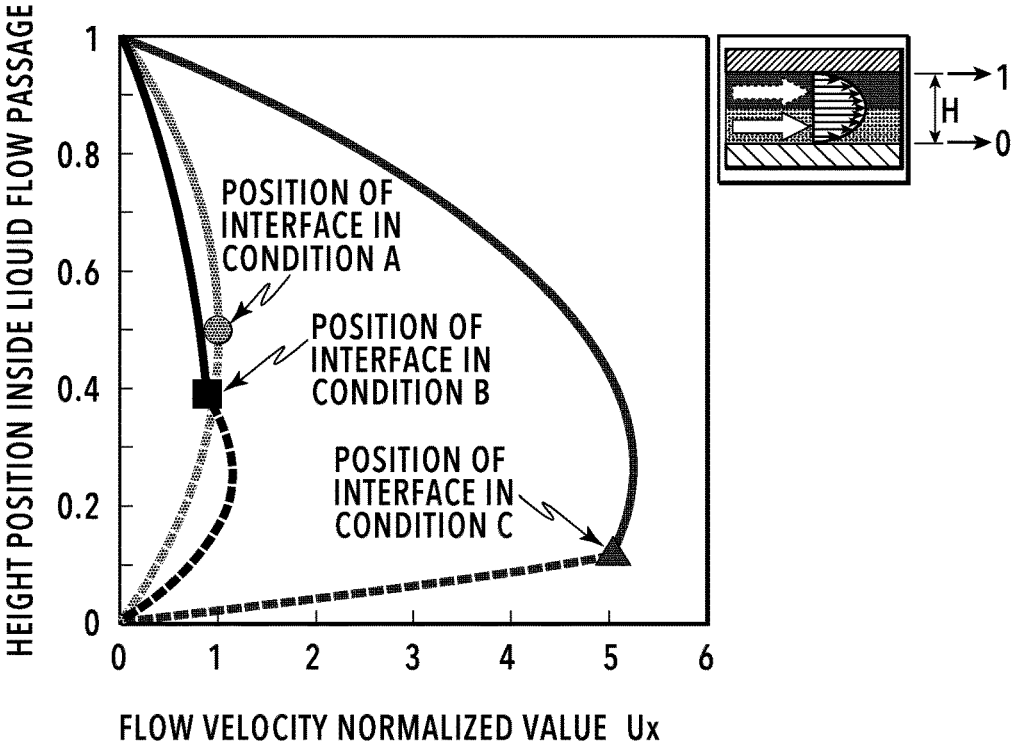
FIG. 6B is an explanatory diagram of relations between a height of a pressure chamber and a flow velocity.

Note that condition A, condition B, and condition C in FIG. 6A represent the following conditions:

the viscosity ratio $\eta_r=1$, the flow rate ratio $Q_r=1$, and the water phase thickness ratio $hr=0.50$; Condition A:

the viscosity ratio $\eta_r=10$, the flow rate ratio $Q_r=1$, and the water phase thickness ratio $hr=0.39$; and Condition B:

the viscosity ratio $\eta_r=10$, the flow rate ratio $Q_r=10$, and the water phase thickness ratio $hr=0.12$. Condition C:

FIG. 6B is a graph showing flow velocity distribution in the height direction (the z direction) of the liquid flow passage 13 (the pressure chamber) regarding the above-mentioned conditions A, B, and C. The horizontal axis indicates a normalized value Ux which is normalized by defining the maximum flow velocity value in the condition A as 1 (a criterion). The vertical axis indicates the height from a bottom surface in the case where the height H [μm] of the liquid flow passage 13 (the pressure chamber) is defined as 1 (a criterion). On each of curves indicating the respective conditions, the position of the interface between the first liquid and the second liquid is indicated with a marker. FIG. 6B shows that the position of the interface varies depending on the conditions such as the position of the interface in the condition A being located higher than the positions of the interface in the condition B and the condition C. The reason for this is that, in the case where the two types of liquids having different viscosities from each other flow in parallel in the tube while forming the laminar flows, the interface between those two liquids is formed at a position where a difference in pressure attributed to the difference in viscosity between the liquids balances a Laplace pressure attributed to interfacial tension.

(Flows of Liquids During Ejection Operation)

As the first liquid and the second liquid flow severally, a liquid level (the liquid-liquid interface) is formed at a position corresponding to the viscosity ratio $\eta_r$ and the flow rate ratio $Q_r$ therebetween (corresponding to the water phase thickness ratio $h_r$). If the liquids are successfully ejected from the ejection port 11 while maintaining the position of the interface, then it is possible to achieve a stable ejection operation. The following are two possible configurations for achieving the stable ejection operation:

Configuration 1: a configuration to eject the liquids in a state where the first liquid and the second liquid are flowing; and Configuration 2: a configuration to eject the liquids in a state where the first liquid and the second liquid are at rest.

The condition 1 makes it possible to eject the liquids stably while retaining the given position of the interface. This is due to a reason that an ejection velocity (several meters per second to ten something meters per second) of a droplet in general is faster than flow velocities (several millimeters per second to several meters per second) of the first liquid and the second liquid, and the ejection of the liquids is affected little even if the first liquid and the second liquid are kept flowing during the ejection operation.

In the meantime, the condition 2 also makes it possible to eject the liquids stably while retaining the given position of the interface. This is due to a reason that the first liquid and the second liquid are not mixed immediately due to a diffusion effect on the liquids on the interface, and an unmixed state of the liquids is maintained for a very short period of time. Accordingly, at the point immediately before ejection of the liquids, the interface is maintained in the state where the flows of the liquids are stopped to remain at rest, so that the liquids can be ejected while retaining the position of the interface. However, the configuration 1 is preferable because this configuration can reduce adverse effects of mixture of the first and second liquids due to the diffusion of the liquids on the interface and it is not necessary to conduct advanced control for flowing and stopping the liquids.

(Ejection Modes of Liquids)

A proportion of the first liquid contained in droplets of the second liquid ejected from the ejection port (ejected droplets) can be changed by adjusting the position of the interface (corresponding to the water phase thickness ratio $h_r$). Such ejection modes of the liquids can be broadly categorized into two modes depending on types of the ejected droplets:

Mode 1: a mode of ejecting only the second liquid; and

Mode 2; a mode of ejecting the second liquid inclusive of the first liquid.

The mode 1 is effective, for example, in a case of using a liquid ejection head of a thermal type that employs an electrothermal converter (a heater) as the pressure generation element 12, or in other words, in a case of using a liquid ejection head that utilizes a bubbling phenomenon that depends heavily on properties of a liquid. This liquid ejection head is prone to destabilize bubbling of the liquid due to a scorched portion of the liquid developed on a surface of the heater. The liquid ejection head also has a difficulty in ejecting some types of liquids such as non-aqueous inks. However, if a bubbling agent that is suitable for bubble generation and is less likely to develop scorch on the surface of the heater is used as the first liquid and any of functional agents having a variety of functions is used as the second liquid by adopting the mode 1, it is possible to eject the liquid such as a non-aqueous ink while suppressing the development of the scorch on the surface of the heater.

The mode 2 is effective for ejecting a liquid such as a high solid content ink not only in the case of using the liquid ejection head of the thermal type but also in a case of using a liquid ejection head that employs a piezoelectric element as the pressure generation element 12. To be more precise, the mode 2 is effective in the case of ejecting a high-density pigment ink having a large content of a pigment being a coloring material onto a printing medium. In general, by increasing the density of the pigment in the pigment ink, it is possible to improve chromogenic properties of an image printed on a printing medium such as plain paper by using the high-density pigment ink. Moreover, by adding a resin emulsion (resin EM) to the high-density pigment ink, it is possible to improve abrasion resistance and the like of a printed image owing to the resin EM formed into a film. However, an increase in solid component such as the pigment and the resin EM tends to develop agglomeration at a close interparticle distance, thus causing deterioration in dispersibility. The pigment is especially harder to disperse than the resin EM. For this reason, the pigment and the resin EM are dispersed by reducing the amount of one of them, or more specifically, by setting an amount ratio of the pigment to the resin EM to about 4/15 wt % or 8/4 wt %. On the other hand, by using a high-density resin EM ink as the first liquid and using the high-density pigment ink as the second ink liquid while adopting the mode 2, it is possible to eject the high-density resin EM ink and the high-density pigment ink at a predetermined proportion. As a consequence, it is possible to print an image by depositing the high-density pigment ink and the high-density resin EM ink on the printing medium (the amount ratio of the pigment to the resin EM at about 8/15 wt %), thereby printing a high-quality image that can hardly achievable with a single ink, or in other words, an image with excellent abrasion resistance and the like.

(Relation Between Flow Rate Ratio and Water Phase Thickness Ratio)

Figure 7:
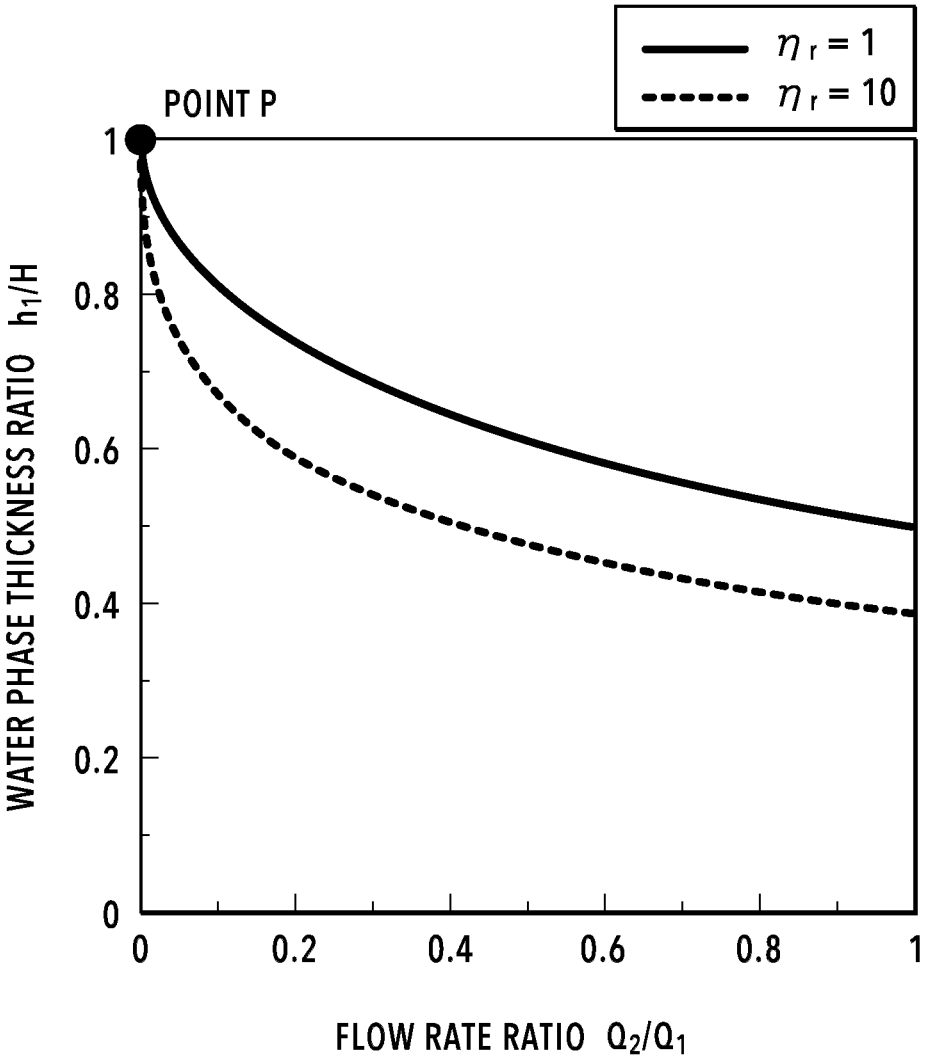
FIG. 7 is an explanatory diagram of relations between a flow rate ratio and the water phase thickness ratio.

FIG. 7 is a graph showing a relation between the flow rate ratio $Q_r$ and the water phase thickness ratio $h_r$ based on the (formula 2) in the case where the viscosity ratio $\eta_r=1$ and in the case where the viscosity ratio $\eta_r=10$. The horizontal axis indicates the flow rate ratio $Q_r=Q_2/Q_1$ and the vertical axis indicates the water phase thickness ratio $h_r=h_1/(h_1+h_2)=h_1/H$. The flow rate ratio $Q_r=0$ corresponds to the case of $Q_2=0$, where the liquid flow passage and the pressure chamber are filled with the first liquid only and there is no second liquid therein. Here, the water phase thickness ratio $h_r$ is equal to 1. A point P in FIG. 7 represent the state with the flow rate ratio $Q_r=0$.

If the ratio $Q_r$ is set higher than the position of the point P (if a flow rate $Q_2$ of the second liquid is set higher than 0), the water phase thickness ratio $h_r$ becomes lower (the phase thickness $h_1$ of the first liquid becomes smaller and the phase thickness $h_2$ of the second liquid becomes larger). In other words, the state of the flow of the first liquid only transitions to the state of the first liquid and the second liquid flowing in parallel while defining the interface. Moreover, it is possible to confirm the above-mentioned tendency both in the case where the viscosity ratio $\eta_r=1$ and in the case where the viscosity ratio $\eta_r=10$ between the first liquid and the second liquid. In other words, in order to establish the state where the first liquid and the second liquid flow in the liquid flow passage 13 and the pressure chamber 18 along with each other while defining the interface therebetween, it is necessary to satisfy the flow rate ratio $Q_r=Q_2/Q_1>0$, or in other words, to satisfy $\eta_r>0$ and $Q_2>0$. This means that both of the first liquid and the second liquid are flowing in the y direction.

(Transitional States in Ejection Operation)

Next, a description will be given of transitional states in an ejection operation in the liquid flow passage 13 in which the parallel flows are formed. FIGS. 8A to 8E are diagrams illustrating transitional states in the case of carrying out an ejection operation in a state of forming the parallel flows of the first liquid and the second liquid with the viscosity ratio $\eta_r=4$ in the liquid flow passage 13 having the height of the flow passage of H [μm]=20 μm with the thickness of the orifice plate of T [μm]=6 μm.

Figures 8A, 8B, 8C, 8D, 8E:
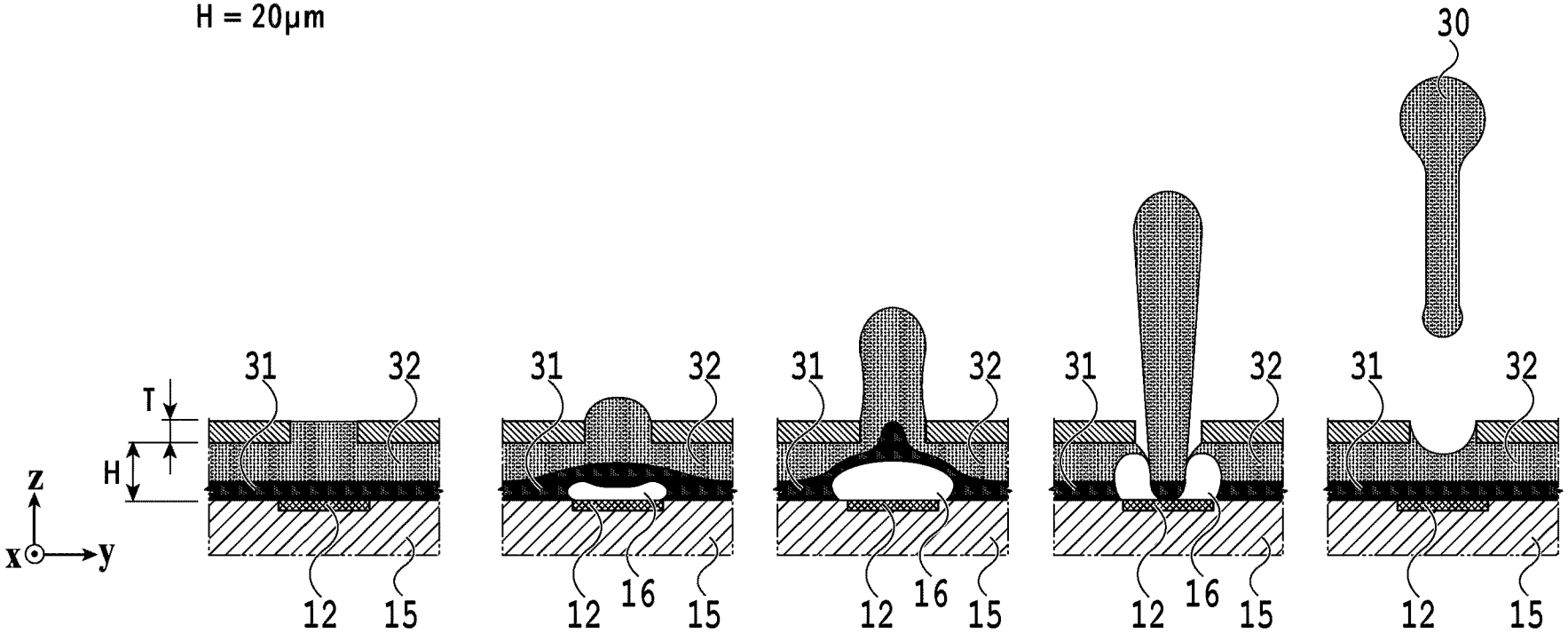
FIGS. 8A to 8E are explanatory diagrams of transitional states in an ejection operation.
Figures 9A, 9B, 9C, 9D, 9E, 9F, 9G:
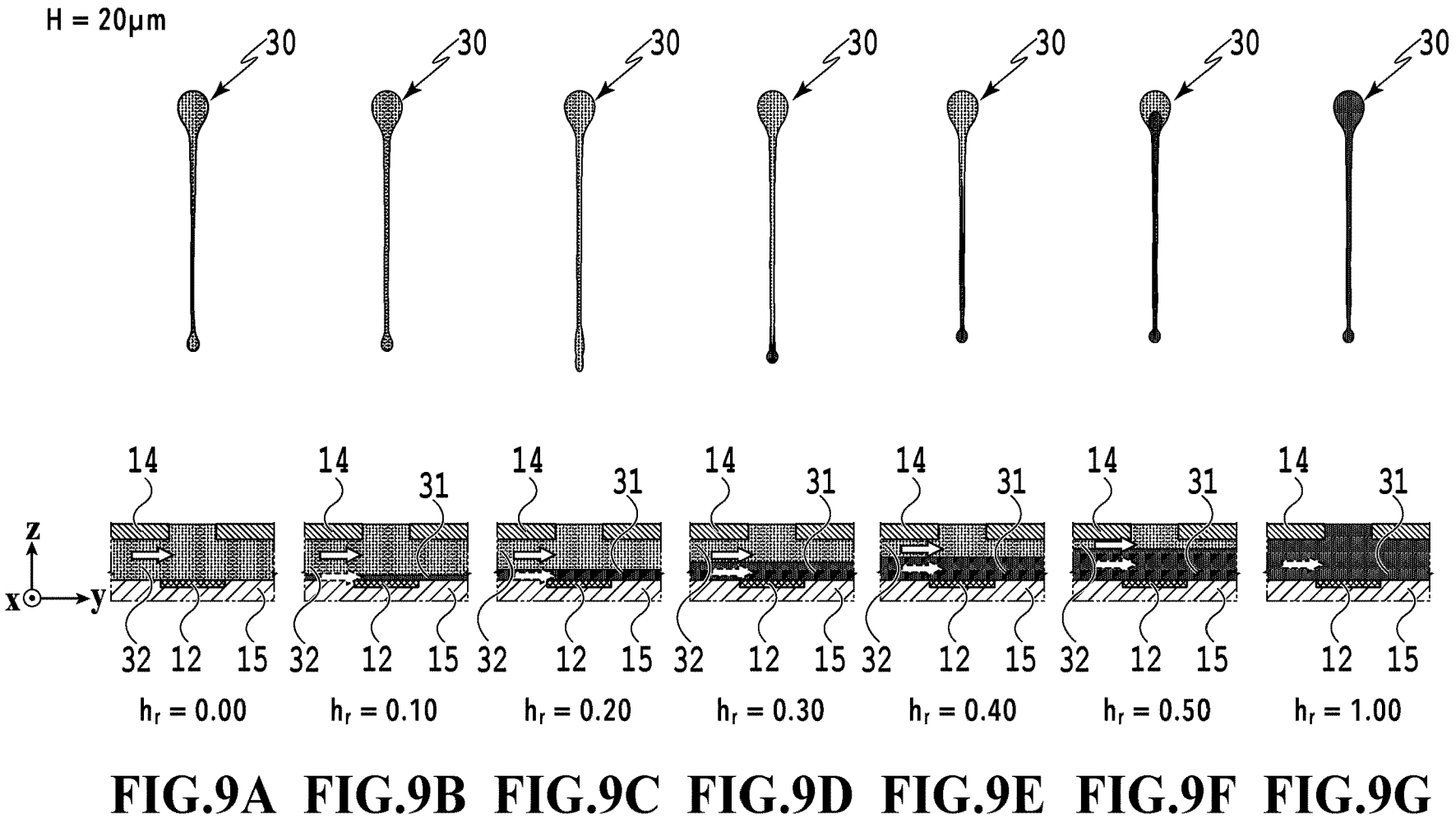
FIGS. 9A to 9G are explanatory diagrams of ejected droplets at various water phase thickness ratios.
Figures 10A, 10B, 10C, 10D, 10E:
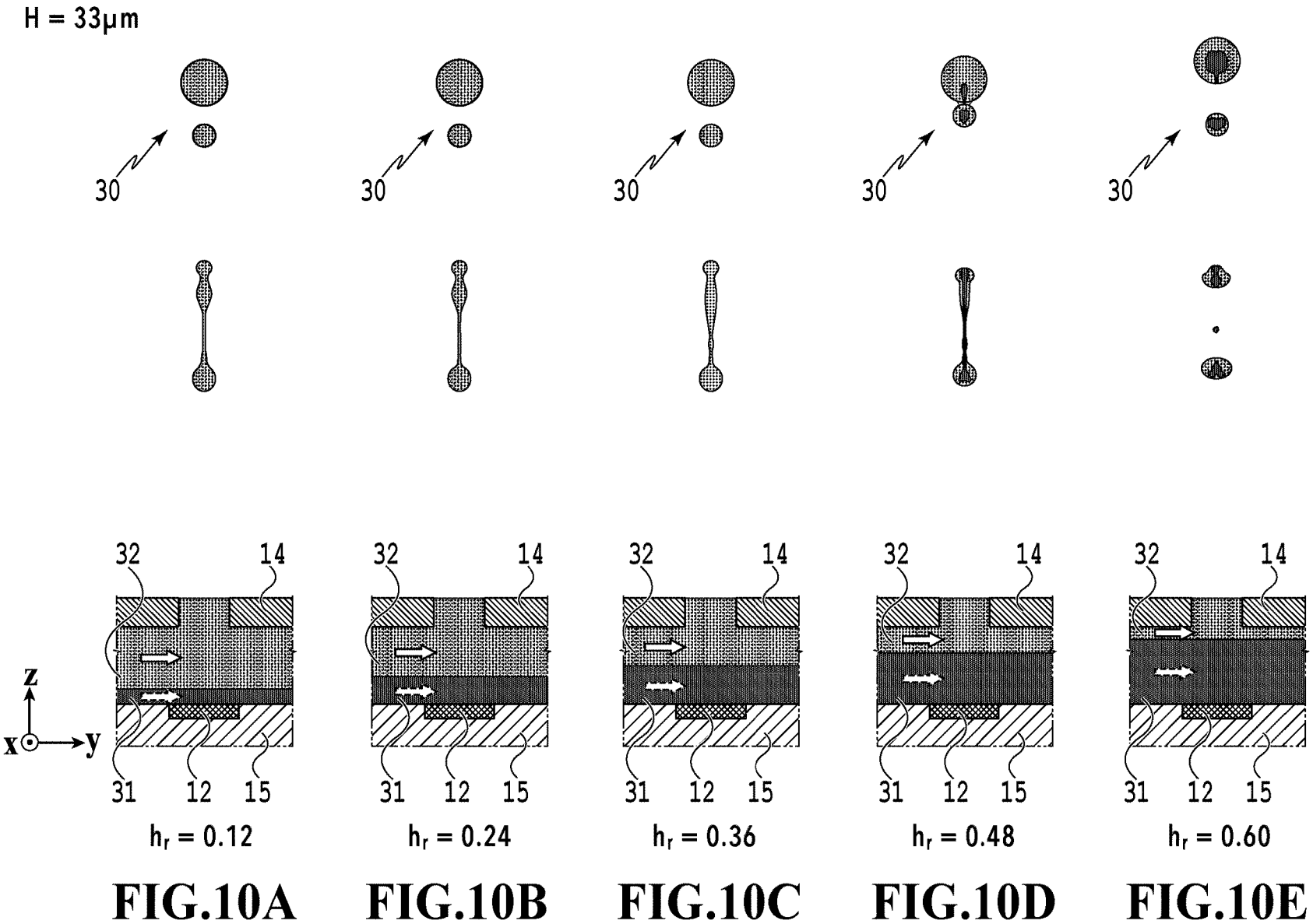
FIGS. 10A to 10E are more explanatory diagrams of ejected droplets at various water phase thickness ratios.

FIG. 8A shows a state before a voltage is applied to the pressure generation element 12. Here, FIG. 8A shows the state where the position of the interface is stable at such a position that achieves the water phase thickness ratio $\eta_r=0.57$ (that is, the water phase thickness of the first liquid $h_1$ [μm]=6 μm) by appropriately adjusting the flow rate $Q_1$ of the first liquid and the flow rate $Q_2$ of the second liquid which flow together.

FIG. 8B shows a state where application of the voltage to the pressure generation element 12 has just been started. The pressure generation element 12 of this embodiment is an electrothermal converter (a heater). The pressure generation element 12 rapidly generates heat upon receipt of a voltage pulse in response to the ejection signal, and causes film boiling of in the first liquid in contact via the inner wall of the liquid flow passage. FIG. 8B shows the state where a bubble 16 is generated by the film boiling. Along with the generation of the bubble 16, the interface between the first liquid 31 and the second liquid 32 moves in the z direction whereby the second liquid 32 is pushed out of the ejection port 11 in the z direction.

FIG. 8C shows a state where the voltage application to the pressure generation element 12 is continued. A volume of the bubble 16 is increased by the film boiling and the second liquid 32 is further pushed out of the ejection port 11 in the z direction. FIG. 8D shows a state where the voltage application to the pressure generation element 12 is further continued whereby the grown bubble 16 communicates with the atmosphere.

FIG. 8E shows a state where a droplet (ejected droplet) 30 is ejected. The liquid having ejected from the ejection port 11 at the timing of the communication of the bubble 16 with the atmosphere as shown in FIG. 8D breaks away from the liquid flow passage 13 due to its inertial force and flies in the z direction in the form of the ejected droplet 30. Meanwhile, in the liquid flow passage 13, the liquid in the amount consumed by the ejection is supplied from two sides of the ejection port 11 by capillary force of the liquid flow passage 13 whereby the meniscus is formed again at the ejection port 11. Then, the parallel flows of the first liquid and the second liquid flowing in the y direction are formed again as shown in FIG. 8A.

As described above, in this embodiment, the ejection operation as shown in FIGS. 8A to 8E takes place in the state where the first liquid and the second liquid are flowing as the parallel flows. To describe further in detail with reference to FIG. 2 again, the CPU 500 circulates the first liquid and the second liquid in the liquid ejection head 1 by using the liquid circulation unit 504 while keeping the constant flow rates of these liquids. Then the CPU 500 applies the voltage to the respective pressure generation elements 12 arranged in the liquid ejection head 1 in accordance with the ejection data while maintaining the above-mentioned control. Here, depending on the amount of the liquid to be ejected, the flow rate of the first liquid and the flow rate of the second liquid may not always be constant.

In the case where the ejection operation is conducted in the state where the liquids are flowing, the flows of the liquids may adversely affect ejection performances. However, in the general inkjet printing head, an ejection velocity of each droplet is in the order of several meters per second to ten something meters per second, which is much higher than the flow velocity in the liquid flow passage that is in the order of several millimeters per second to several meters per second. Accordingly, even if the ejection operation is conducted in the state where the first liquid and the second liquid are flowing in the range from several millimeters per second to several meters per second, there is little risk of adverse effects on the ejection performances.

This embodiment shows the configuration in which the bubble 16 communicates with the atmosphere in the pressure chamber 18. However, the embodiment is not limited to this configuration. For instance, the bubble 16 may communicate with the atmosphere on the outside (the atmosphere side) of the ejection port 11. Alternatively, the bubble 16 may be allowed to disappear without communicating with the atmosphere.

(Ratios of Liquids Contained in Ejected Droplet)

FIGS. 9A to 9G are diagrams for comparing the ejected droplet in the case where the water phase thickness ratio $h_r$ is changed stepwise in the liquid flow passage 13 (the pressure chamber) having the flow-passage (pressure-chamber) height of H [μm]=20 μm. In FIGS. 9A to 9F, the water phase thickness ratio $h_r$ is incremented by 0.10 whereas the water phase thickness ratio $h_r$ is incremented by 0.50 from the state in FIG. 9F to the state in FIG. 9G. Note that each of the ejected droplets in FIGS. 9A to 9G is illustrated based on a result obtained by conducting a simulation while setting the viscosity of the first liquid to 1 cP, the viscosity of the second liquid to 8 cP, and the ejection velocity of the droplet to 11 m/s.

The water phase thickness ratio $h_1$ of the first liquid 31 is lower as the water phase thickness ratio $h_r$ ($=h_1/(h_1+h_2)$) is closer to 0, and the water phase thickness ratio $h_1$ of the first liquid 31 is lower as the water phase thickness ratio $h_r$ is closer to 1. Accordingly, while the liquid mainly contained in the ejected droplet 30 is the second liquid 32 located close to the ejection port 11, the ratio of the first liquid 31 contained in the ejected droplet 30 is increased as the water phase thickness ratio $h_r$ comes closer to 1.

In the case of FIGS. 9A to 9G where the flow-passage height is set to H [μm]=20 μm, only the second liquid 32 is contained in the ejected droplet 30 if the water phase thickness ratio $h_r$=0.00, 0.10, or 0.20 and no first liquid 31 is contained in the ejected droplet 30. However, in the case where the water phase thickness ratio $h_r$=0.30 or higher, the first liquid 31 is also contained in the ejected droplet 30 besides the second liquid 32. In the case where the water phase thickness ratio $h_r$=1.00 (that is, the state where the second liquid is absent), only the first liquid 31 is contained in the ejected droplet 30. As described above, the ratio between the first liquid 31 and the second liquid 32 contained in the ejected droplet 30 varies depending on the water phase thickness ratio $h_r$ in the liquid flow passage 13 (the pressure chamber).

On the other hand, FIGS. 10A to 10E are diagrams for comparing the ejected droplet 30 in the case where the water phase thickness ratio $h_r$ is changed stepwise in the liquid flow passage 13 (the pressure chamber) having the flow-passage height of H [μm]=33 μm. In this case, only the second liquid 32 is contained in the ejected droplet 30 if the water phase thickness ratio $h_r$=0.36 or below. Meanwhile, the first liquid 31 is also contained in the ejected droplet 30 besides the second liquid 32 in the case where the water phase thickness ratio $h_r$=0.48 or above.

Figures 11A, 11B, 11C:
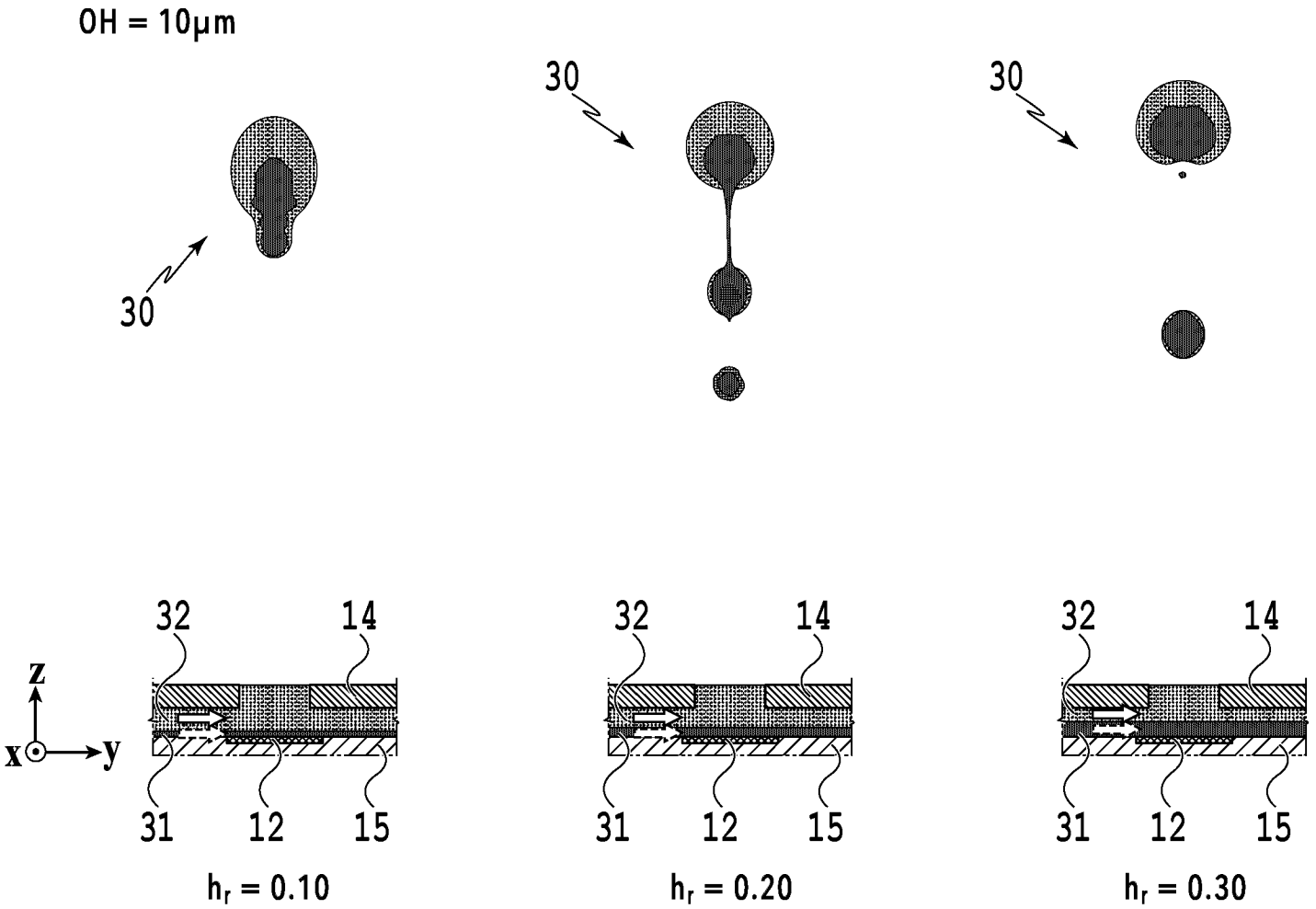
FIGS. 11A to 11C are more explanatory diagrams of ejected droplets at various water phase thickness ratios.

In the meantime, FIGS. 11A to 11C are diagrams for comparing the ejected droplet 30 in the case where the water phase thickness ratio $h_r$ is changed stepwise in the liquid flow passage 13 having the flow-passage (pressure-chamber) height of H [μm]=10 μm. In this case, the first liquid 31 is contained in the ejected droplet 30 even in the case where the water phase thickness ratio $h_r$=0.10.

Figure 12:
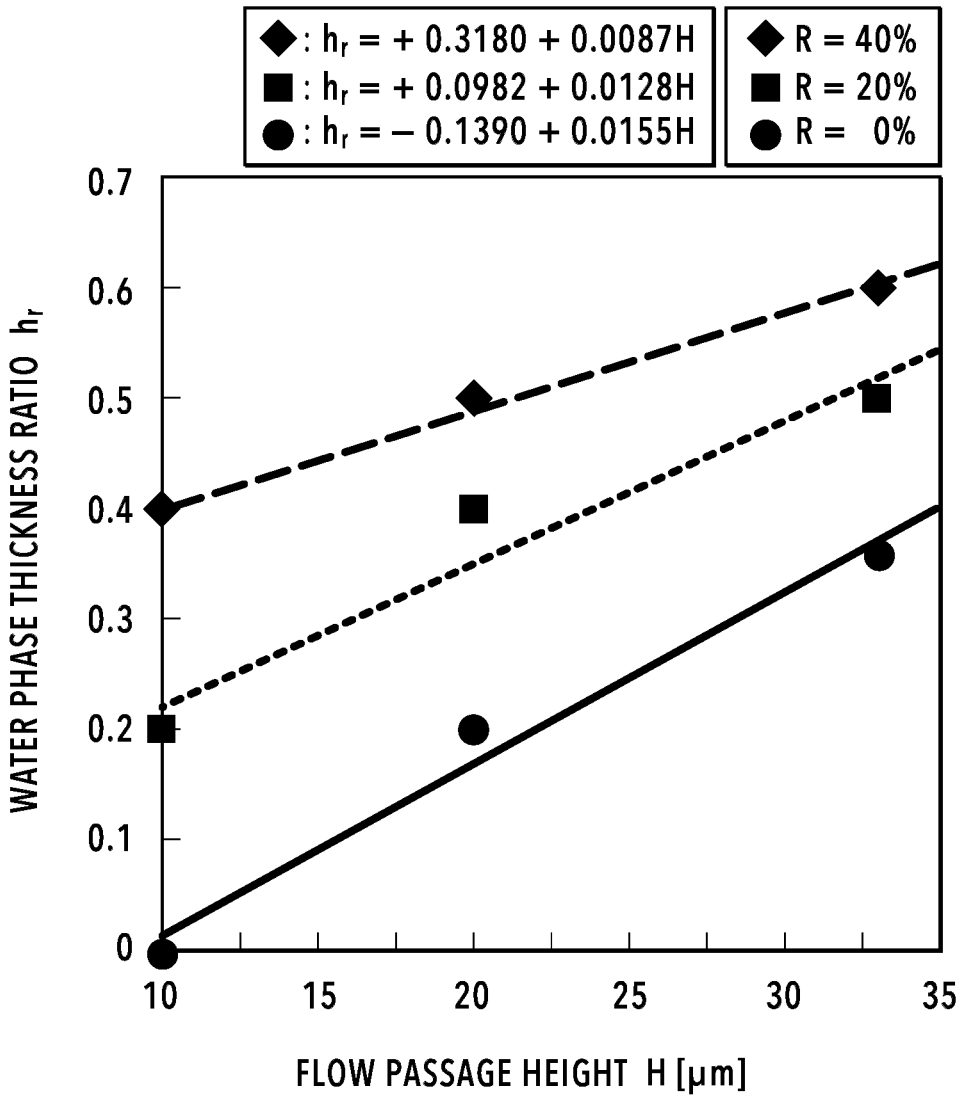
FIG. 12 is a graph representing relations between a height of a flow passage (the pressure chamber) and the water phase thickness ratio.

FIG. 12 is a graph representing a relation between the flow-passage (pressure-chamber) height H and the water phase thickness ratio $h_r$ in the case where a ratio R of the first liquid 31 contained in the ejected droplet 30 is fixed to 0%, 20%, and 40%. In any of the ratios R, the allowable water phase thickness ratio $h_r$ becomes higher as the flow-passage (pressure-chamber) height H is larger. Note that the ratio R of the first liquid 31 contained represents a ratio of the liquid flowing in the liquid flow passage 13 as the first liquid 31 is contained in the ejected droplet. In this regard, even if each of the first liquid and the second liquid contains the same component such as water, the portion of water contained in the second liquid is not included in the aforementioned ratio.

In the case where the ejected droplet 30 contains only the second liquid 32 while eliminating the first liquid (R=0%), the relation between the flow-passage (pressure-chamber) height H [μm] and the water phase thickness ratio $h_r$ is indicated with a solid line in FIG. 12. According to the investigation conducted by the inventors of this disclosure, the water phase thickness ratio $h_r$ can be approximated by a linear function of the flow-passage (pressure-chamber) height H [μm] shown in the following (formula 3):

[Mathematical 2]

$$h_r=-0.1390+0.0155H \quad \text{(formula 3).}$$

Moreover, in the case where the ejected droplet 30 is allowed to contain 20% of the first liquid (R=20%), the water phase thickness ratio $h_r$ can be approximated by a linear function of the flow-passage (pressure-chamber) height H [μm] shown in the following (formula 4):

[Mathematical 3]

$$h_r=+0.0982+0.0128H \quad \text{(formula 4).}$$

Furthermore, in the case where the ejected droplet 30 is allowed to contain 40% of the first liquid (R=40%), the water phase thickness ratio $h_r$ can be approximated by a linear function of the flow-passage (pressure-chamber) height H [μm] shown in the following (formula 5) according to the investigation by the inventors:

[Mathematical 4]

$$h_r=+0.3180+0.0087H \quad \text{(formula 5).}$$

For example, in order for causing the ejected droplet 30 to contain no first liquid, the water phase thickness ratio $h_r$ needs to be adjusted to 0.20 or below in the case where the flow-passage (pressure-chamber) height H [μm] is equal to 20 μm. Meanwhile, the water phase thickness ratio $h_r$ needs to be adjusted to 0.36 or below in the case where the flow-passage (pressure-chamber) height H [μm] is equal to 33 μm. Furthermore, the water phase thickness ratio $h_r$ needs to be adjusted to nearly zero (0.00) in the case where the flow-passage (pressure-chamber) height H [μm] is equal to 10 μm.

Nonetheless, if the water phase thickness ratio $h_r$ is set too low, it is necessary to increase the viscosity 12 and the flow rate $Q_2$ of the second liquid relative to those of the first liquid. Such increases bring about concerns of adverse effects associated with an increase in pressure loss. For example, with reference to FIG. 6A again, in order to realize the water phase thickness ratio $h_r$=0.20, the flow rate ratio $Q_r$ is equal to 5 in the case where the viscosity ratio r is equal to 10. Meanwhile, the flow rate ratio $Q_r$ is equal to 15 if the water phase thickness ratio is set to $h_r$=0.10 in order to obtain certainty of not ejecting the first liquid while using the same ink (that is, in the case of the same viscosity ratio $\eta_r$). In other words, in order for adjusting the water phase thickness ratio $h_r$ to 0.10, it is necessary to increase the flow rate ratio $Q_r$ three times as high as the case of adjusting the water phase thickness ratio $h_r$ to 0.20, and such an increase may bring about concerns of an increase in pressure loss and adverse effects associated therewith.

Accordingly, in an attempt to eject only the second liquid 32 while reducing the pressure loss as much as possible, it is preferable to adjust the value of the water phase thickness ratio $h_r$ as large as possible while satisfying the above-mentioned conditions. To describe this in detail with reference to FIG. 12 again, in the case where the flow-passage (pressure-chamber) height H [μm]=20 μm, it is preferable to adjust the value of the water phase thickness ratio $h_r$ less than 0.20 and as close to 0.20 as possible. Meanwhile, in the case where the flow-passage (pressure-chamber) height H [μm]=33 μm, it is preferable to adjust the value of the water phase thickness ratio $h_r$ less than 0.36 and as close to 0.36 as possible.

Note that the above-mentioned (formula 3), (formula 4), and (formula 5) define the numerical values applicable to the general liquid ejection head, namely, the liquid ejection head with the ejection velocity of the ejected droplets in a range from 10 m/s to 18 m/s. In addition, these numerical values are based on the assumption that the pressure generation element and the ejection port are located at the positions opposed to each other and that the first liquid and the second liquid flow such that the pressure generation element, the first liquid, the second liquid, and the ejection port are arranged in this order in the pressure chamber.

As described above, according to this embodiment, it is possible to stably conduct the ejection operation of the droplet containing the first liquid and the second liquid at the predetermined ratio by setting the water phase thickness ratio $h_r$ in the liquid flow passage 13 and the pressure chamber 18 to the predetermined value and thus stabilizing the position of the interface.

Incidentally, in order to repeat the above-described ejection operation in the stable state, it is necessary to stabilize the position of the interface irrespective of the frequency of the ejection operation while achieving the targeted water phase thickness ratio $h_r$.

Here, a specific method for achieving the above-mentioned state will be described with reference to FIGS. 4A to 5B again. For example, a first pressure difference generation mechanism to set a pressure at the first outflow port 25 lower than a pressure at the first inflow port 20 has only to be prepared in order to adjust a flow rate $Q_1$ of the first liquid in the liquid flow passage 13 and the pressure chamber 18. In this way, it is possible to generate the flow of the first liquid 31 directed from the first inflow port 20 to the first outflow port 25 (in the y direction). In the meantime, a second pressure difference generation mechanism to set a pressure at the second outflow port 26 lower than a pressure at the second inflow port 21 has only to be prepared. In this way, it is possible to generate the flow of the second liquid 32 directed from the second inflow port 21 to the second outflow port 26 (in the y direction).

In order not to cause any reverse flow in the liquid passage and the pressure chamber, the first pressure difference generation mechanism and the second pressure difference generation mechanism are controlled while keeping a relation defined in the following (formula 6):

$$P2_{in} \geq P1_{in} > P1_{out} \geq P2_{out} \quad \text{(formula 6).}$$

Thus, it is possible to form the parallel flows of the first liquid and the second liquid flowing in the y direction at the desired water phase thickness ratio $h_r$ in the liquid flow passage 13 and the pressure chamber 18.

Here, $P1_{in}$ is the pressure at the first inflow port 20, $P1_{out}$ is the pressure at the first outflow port 25, $P2_{in}$ is the pressure at the second inflow port 21, and $P2_{out}$ is the pressure as the second outflow port 26. If the predetermined water phase thickness ratio $h_r$ can be maintained in the liquid flow passage and the pressure chamber by controlling the first and second pressure difference generation mechanisms as described above, it is possible to recover the preferable parallel flows in a short time even if the position of the interface is disturbed along with the ejection operation, and to start the next ejection operation right away.

(Specific Examples of First Liquid and Second Liquid)

In the embodiment described above, functions required by the respective liquids are clarified like the first liquid serving as a bubbling medium for causing the film boiling and the second liquid serving as an ejection medium to be ejected from the ejection port to the outside. According to the configuration of this embodiment, it is possible to increase the freedom of components to be contained in the first liquid and the second liquid more than those in the related art. Now, the bubbling medium (the first liquid) and the ejection medium (the second liquid) in this configuration will be described in detail based on specific examples.

The bubbling medium (the first liquid) of this embodiment is required to cause the film boiling in the bubbling medium in the case where the electrothermal converter generates the heat and to rapidly increase the size of the generated bubble, or in other words, to have a high critical pressure that can efficiently convert thermal energy into bubbling energy. Water is particularly suitable for such a medium. Water has the high boiling point (100° C.) as well as the high surface tension (58.85 dynes/cm at 100° C.) despite its small molecular weight of 18, and therefore has a high critical pressure of about 22 MPa. In other words, water brings about an extremely high boiling pressure at the time of the film boiling. In general, an ink prepared by causing water to contain a coloring material such as a dye or a pigment is suitably used in an inkjet printing apparatus designed to eject the ink by using the film boiling.

However, the bubbling medium is not limited to water. Other materials can also function as the bubbling media as long as such a material has a critical pressure of 2 MPa or above (or preferably 5 MPa or above). The bubbling media other than water include methyl alcohol and ethyl alcohol. It is also possible to use a mixture of water and any of these alcohols as the bubbling medium. Moreover, it is possible to use a material prepared by causing water to contain the coloring material such as the dye and the pigment as mentioned above as well as other additives. As a consequence, the pressure is applied to the above-described bubbling medium (the first liquid) by the action of the pressure generation element, and the ejection medium (the second liquid) is thus ejected from the ejection port.

On the other hand, the ejection medium (the second liquid) of this embodiment is not required to satisfy physical properties for causing the film boiling unlike the bubbling medium. Meanwhile, adhesion of a scorched material onto the electrothermal converter (the heater) is prone to deteriorate bubbling efficiency because of damaging flatness of a heater surface or reducing thermal conductivity thereof. However, the ejection medium does not come into contact with the heater, and therefore has a lower risk of scorch of its components. Concerning the ejection medium of this embodiment, conditions of the physical properties for causing the film boiling or avoiding the scorch are relaxed as compared to those of an ink for a conventional thermal head. Accordingly, the ejection medium of this embodiment enjoys more freedom of the components to be contained therein. As a consequence, the ejection medium can more actively contain the components that are suitable for purposes after being ejected.

For example, in this embodiment, it is possible to actively contain as the ejection medium a pigment that has not been used previously because the pigment was susceptible to scorching on the heater. Meanwhile, a liquid other than an aqueous ink having an extremely low critical pressure can also be used as the ejection medium in this embodiment. Furthermore, it is also possible to use various inks having special functions, which can hardly be handled by the conventional thermal head such as an ultraviolet curable ink, an electrically conductive ink, an electron-beam (EB) curable ink, a magnetic ink, and a solid ink, can also be used as the ejection media. In the meantime, the liquid ejection head of this embodiment can also be used in various applications other than image formation by using, for example, any of blood, cells in culture, and the like as the ejection media. The liquid ejection head is also adaptable to other applications including biochip fabrication, electronic circuit printing, and so forth. Since there are no restrictions regarding the second liquid, the second liquid may adopt the same liquid as one of those cited as the examples of the first liquid. For instance, even if both of the two liquids are inks each containing a large amount of water, it is still possible to use one of the inks as the first liquid and the other ink as the second liquid depending on situations such as a mode of usage.

Particularly, the mode of using water or a liquid similar to water as the first liquid (the bubbling medium) and a pigment ink having a higher viscosity than that of water as the second liquid (the ejection medium), and ejecting only the second liquid is one of effective usages of this embodiment. In this case as well, it is effective to suppress the water phase thickness ratio $h_r$ by setting the flow rate ratio $Q_r=Q_2/Q_1$ as low as possible as shown in FIG. 6A.

(Ejection Medium that Require Parallel Flows of Two Liquids)

In the case where the liquid to be ejected has been determined, the necessity of causing the two liquids to flow in the liquid flow passage (the pressure chamber) in such a way as to form the parallel flows may be determined based on the critical pressure of the liquid to be ejected. For example, the second liquid may be determined as the liquid to be ejected while the bubbling material serving as the first liquid may be prepared only in the case where the critical pressure of the liquid to be ejected is insufficient.

Figure 13A:
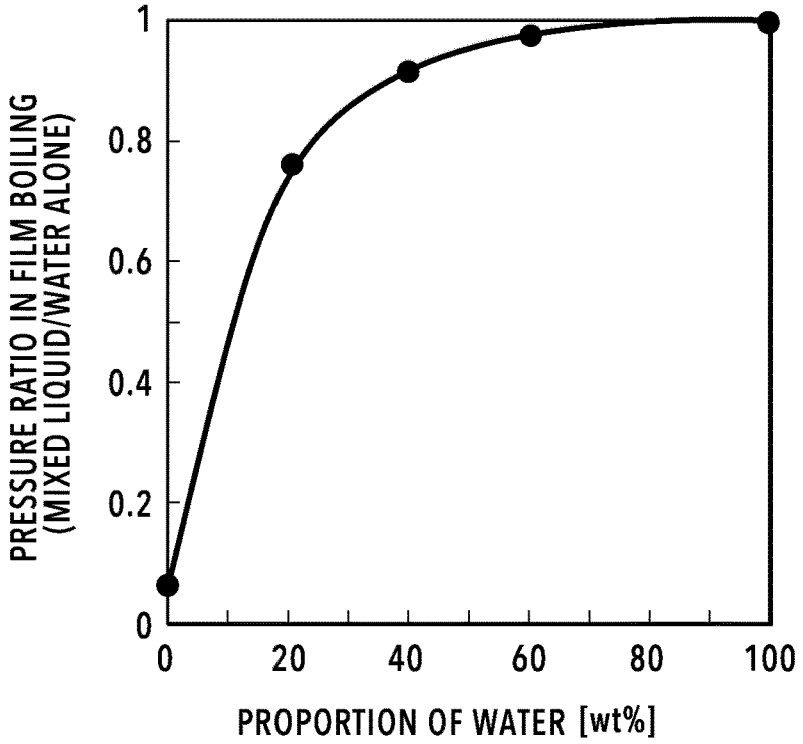
FIG. 13A is an explanatory diagram of a relation between a mass percentage (percent by mass) of water relative to a liquid and a bubbling pressure.
Figure 13B:
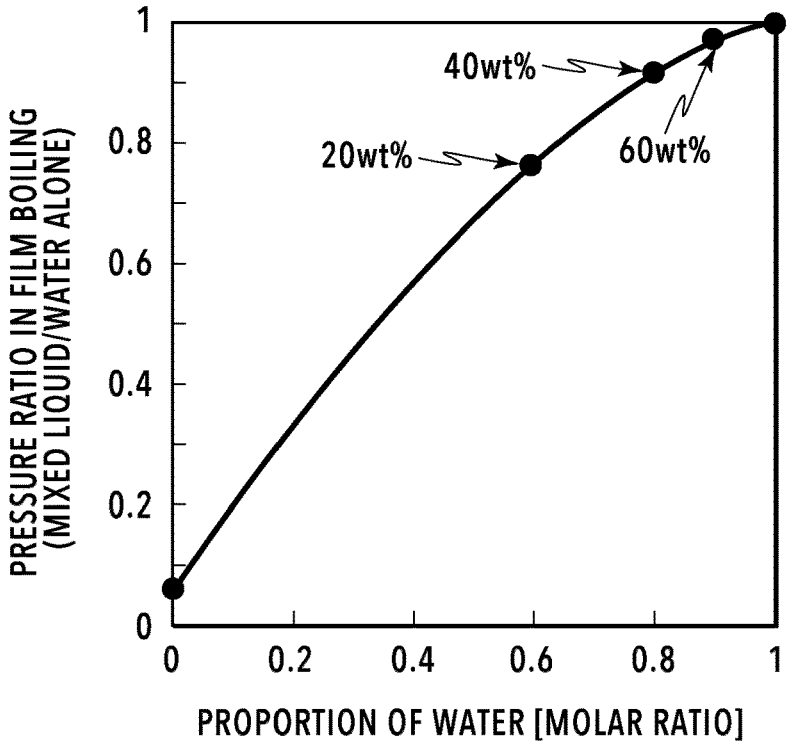
FIG. 13B is an explanatory diagram of a relation between a molar ratio of the water relative to the liquid and the bubbling pressure.

FIGS. 13A and 13B are graphs representing relations between a water content rate and a bubbling pressure at the time of the film boiling in the case where diethylene glycol (DEG) is mixed with water. The horizontal axis in FIG. 13A indicates a mass ratio (in percent by mass) of water relative to the liquid, and the horizontal axis in FIG. 13B indicates a molar ratio of water relative to the liquid.

As apparent from FIGS. 13A and 13B, the bubbling pressure at the time of the film boiling becomes lower as the water content rate (content percentage) is lower. In other words, the bubbling pressure is reduced more as the water content rate becomes lower, and ejection efficiency is deteriorated as a consequence. Nonetheless, the molecular weight of water (18) is substantially smaller than the molecular weight of diethylene glycol (106). Accordingly, even if the mass ratio of water is around 40 wt %, its molar ratio is about 0.9 and the bubbling pressure ratio is kept at 0.9. On the other hand, if the mass ratio of water falls below 40 wt %, the bubbling pressure ratio sharply drops together with the molar concentration as apparent from FIGS. 13A and 13B.

As a consequence, in the case where the mass ratio of water falls below 40 wt %, it is preferable to prepare the first liquid separately as the bubbling medium and to form the parallel flows of these two liquids in the liquid flow passage (the pressure chamber). As described above, in the case where the liquid to be ejected has been determined, the necessity of forming the parallel flows in the flow passage (the pressure chamber) can be determined based on the critical pressure of the liquid to be ejected (or on the bubbling pressure at the time of the film boiling).

(Ultraviolet Curable Ink as Example of Ejection Medium)

A preferable composition of an ultraviolet curable ink that can be used as the ejection medium in this embodiment will be described as an example. The ultraviolet curable inks can be categorized into a 100-percent solid type ink formed from a polymerization reaction component without a solvent, and an ink containing either water being of a solvent type or a solvent as a diluent. The ultraviolet curable inks actively used in recent years are 100-percent solid ultraviolet curable inks formed from non-aqueous photopolymerization reaction components (which are either monomers or oligomers) without containing any solvents. Such an ultraviolet curable ink contains monomers as a main component, and also contains small amounts of other additives including a photopolymerization initiator, a coloring material, a dispersant, a surfactant, and the like. Broadly speaking, the components of this ink include the monomers in a range from 80 to 90 wt %, the photopolymerization initiator in a range from 5 to 10 wt %, the coloring material in a range from 2 to 5 wt %, and other additives for the rest. As described above, even in the case of the ultraviolet curable ink that has been hardly handled by the conventional thermal head, it is possible to use this ink as the ejection medium in this embodiment and to eject the ink out of the liquid ejection head by conducting the stable ejection operation. This makes it possible to print an image that is excellent in image robustness as well as abrasion resistance as compared to the related art.

(Example of Using Mixed Liquid as Ejected Droplet)

Next, a description will be given of a case of the ejected droplet 30 in which the first liquid 31 and the second liquid 32 are mixed at a predetermined ratio. For instance, in the case where the first liquid 31 and the second liquid 32 are inks having colors different from each other, these inks flow as laminar flows without being mixed in the liquid flow passage 13 and the pressure chamber 18 as long as the viscosities and the flow rates of the two liquids satisfy the relation defined by (formula 2). In other words, by controlling the flow rate ratio $Q_r$ between the first liquid 31 and the second liquid 32 in the liquid flow passage and the pressure chamber, it is possible to adjust the water phase thickness ratio $h_r$ and therefore a mixing ratio between the first liquid 31 and the second liquid 32 in the ejected droplet to a desired ratio.

For example, assuming that the first liquid is a clear ink and the second liquid is cyan ink (or magenta ink), it is possible to eject light cyan ink (or light magenta ink) at various concentrations of the coloring material by controlling the flow rate ratio $Q_r$. Alternatively, assuming that the first liquid is yellow ink and the second liquid is magenta, it is possible to eject red ink at various color phase levels that are different stepwise by controlling the flow rate ratio $Q_r$. In other words, if it is possible to eject the droplet prepared by mixing the first liquid and the second liquid at the desired mixing ratio, then a range of color reproduction expressed on a printed medium can be expanded more than the related art by appropriately adjusting the mixing ratio.

Moreover, the configuration of this embodiment is also effective in the case of using two types of liquids that are desired to be mixed together immediately after the ejection instead of mixing the liquids immediately before the ejection. For example, there is a case in image printing where it is desirable to deposit a high-density pigment ink with excellent chromogenic properties and a resin EM excellent in image robustness such as abrasion resistance on a printing medium at the same time. However, a pigment component contained in the pigment ink and a solid component contained in the resin EM tend to develop agglomeration at a close interparticle distance, thus causing deterioration in dispersibility. In this regard, if the high-density EM is used as the first liquid of this embodiment while the high-density pigment ink is used as the second liquid thereof and the parallel flows are formed by controlling the flow velocities of these liquids based on (formula 2), then the two liquids are mixed with each other and agglomerated together on the printing medium after being ejected. In other words, it is possible to maintain a desirable state of ejection under high dispersibility and to obtain an image with high chromogenic properties as well as high robustness after deposition of the droplets.

Note that in the case where the mixture after the ejection is intended as mentioned above, this embodiment exerts an effect of generating the flows of the two liquids in the pressure chamber regardless of the mode of the pressure generation element. In other words, this embodiment also functions effectively in the case of a configuration to use a piezoelectric element as the pressure generation element, for instance, where the limitation in the critical pressure or the problem of the scorch is not concerned in the first place.

As described above, according to this embodiment, it is possible to conduct the ejection operation favorably and stably by driving the pressure generation element 12 in the state where the first liquid and the second liquid are caused to flow steadily while keeping the predetermined water phase thickness ratio $h_r$ in the liquid flow passage and the pressure chamber.

By driving the pressure generation element 12 in the state where the liquids are caused to flow steadily, the stable interface can be formed at the time of ejecting the liquids. If the liquids are not flowing during the ejection operation of the liquids, the interface is prone to be disturbed as a consequence of generation of the bubble, and the printing quality may also be affected in this case. By driving the pressure generation element 12 while allowing the liquids to flow as described in this embodiment, it is possible to suppress the turbulence of the interface due to the generation of the bubble. Since the stable interface is formed, the content rate of various liquids contained in the ejected liquid is stabilized and the printing quality is also improved, for example. Moreover, since the liquids are caused to flow before driving the pressure generation element 12 and to flow continuously even during the ejection, it is possible to reduce time for forming the meniscus again in the liquid flow passage (the pressure chamber) after the ejection of the liquids. Meanwhile, the flows of the liquids are created by using a pump or the like loaded in the liquid circulation unit 504 before the driving signal is inputted to the pressure generation element 12. As a consequence, the liquids are flowing at least immediately before the ejection of the liquids.

(Relation Between Inflow Port and Flow Passage Width)

Figure 14A:
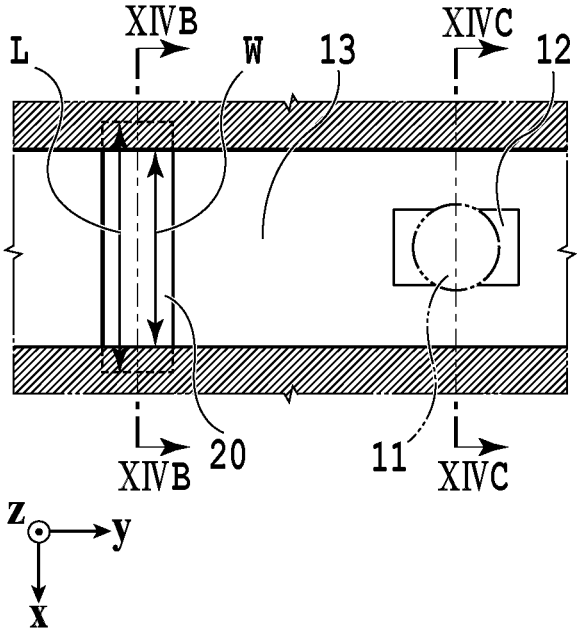
FIG. 14A is a top plan view of a first inflow port section of the first embodiment.
Figure 14B:
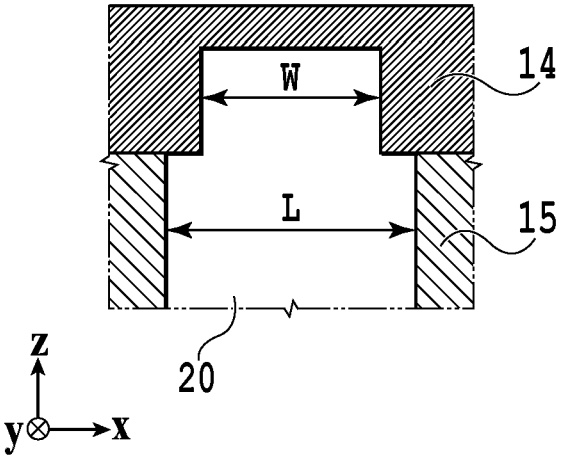
FIG. 14B is a cross-sectional view taken along the XIVB-XIVB line in FIG. 14A.
Figure 14C:
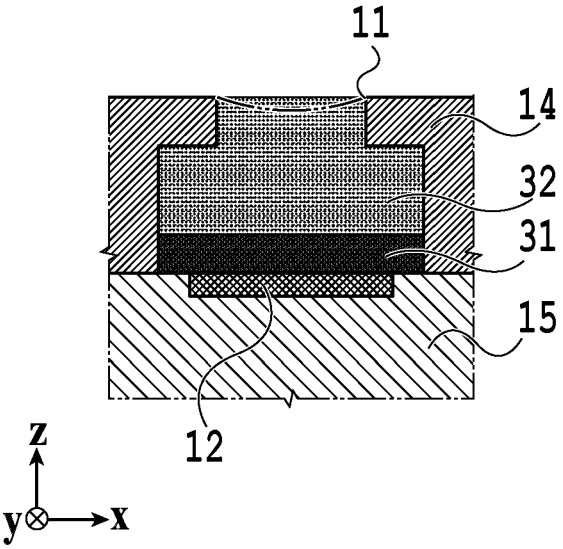
FIG. 14C is a cross-sectional view taken along the XIVC-XIVC line in FIG. 14A.

FIG. 14A is a top plan view of the first inflow port 20 section, FIG. 14B is a cross-sectional view taken along the XIVB-XIVB line in FIG. 14A, and FIG. 14C is a cross-sectional view (an enlarged diagram of the pressure chamber) taken along the XIVC-XIVC line in FIG. 14A. A length (or dimension) of the first inflow port 20 in a direction orthogonal to the direction of flow of the liquid in the pressure chamber and a direction of ejection of the liquid from the ejection port (hereinafter also referred to as a width direction of the liquid flow passage) will be defined as L. Meanwhile, a length (a width or dimension) of the liquid flow passage above the first inflow port 20 will be defined as W. In this case, L>W holds true in FIGS. 14A and 14B. Accordingly, the first inflow port 20 extends across the entire region in the width direction of the liquid flow passage 13. The first inflow port 20 of this embodiment linearly extends in the width direction of the liquid flow passage 13 (the direction orthogonal to the direction of flow (the y direction)) and the length L of the first inflow port 20 is greater than the length (the width) W of the liquid flow passage 13. Meanwhile, two end portions of the first inflow port 20 are located outside upper and lower wall surfaces of the liquid flow passage 13 in FIG. 14A. Instead, the two end portions of the first inflow port 20 may be located at the same positions as the corresponding wall surfaces of the liquid flow passage 13, respectively. In this case, L=W holds true. Alternatively, one of the two end portions of the first inflow port 20 may be located at the same position as the corresponding wall surface of the liquid flow passage 13 while the other end portion may be located outside the corresponding wall surface of the liquid flow passage 13. In this case, L>W holds true. In the example of FIG. 4A, not only the length in the width direction of the first inflow port 20, but also the lengths in the width direction of the second inflow port 21, the first outflow port 25, and the second outflow port 26 in the width direction of the liquid flow passage 13 are greater than the length (the width) W of the liquid flow passage 13. Note that at least the length L of the first inflow port 20 needs to be equal to or greater than the length (the width) W of the liquid flow passage 13. In other words, at least the first inflow port 20 has to satisfy L≥W.

The first liquid 31 is fed into the entire region in the width direction of the liquid flow passage 13 from the above-described inflow port 20. As a consequence, the parallel flows of the first liquid 31 and the second liquid 32 stacked in the height direction (a direction from the pressure generation element toward the ejection port) of the liquid flow passage 13 are formed as shown in FIG. 14C. In other words, the second liquid 32 flows above and along the first liquid 31. The interface between the first liquid 31 and second liquid 32 is formed well in the height direction of the liquid flow passage 13. Inside the pressure chamber, the first liquid 31 flows at a position on the pressure generation element 12 side while the second liquid 32 flows at a position on the ejection port 11 side. Accordingly, it is possible to use water that is apt to cause bubbling as the first liquid 31 and to use the pigment ink having a high viscosity and a large amount of solid components such as the pigment as the second liquid 32, for example. In other words, regardless of what the second liquid 32 is, it is possible to eject the second liquid 32 stably by bubbling the first liquid 31. For instance, in the case where the second liquid 32 is the ink, it is possible to print a high-quality image.

Figure 15A:
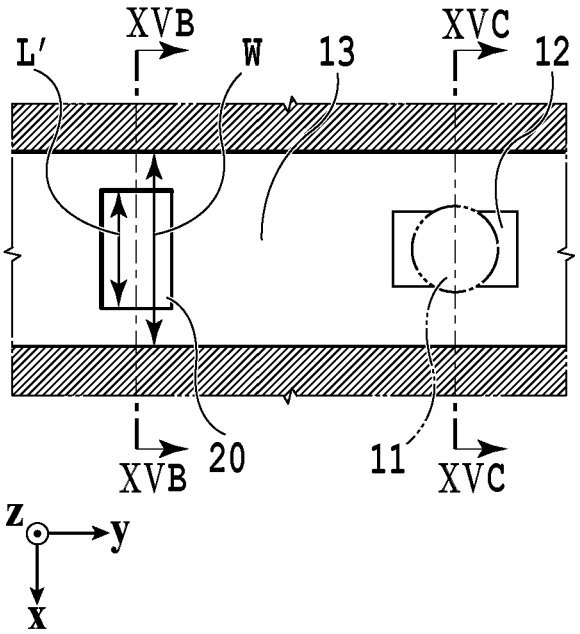
FIG. 15A is a top plan view of a first inflow port section of a comparative example.
Figure 15B:
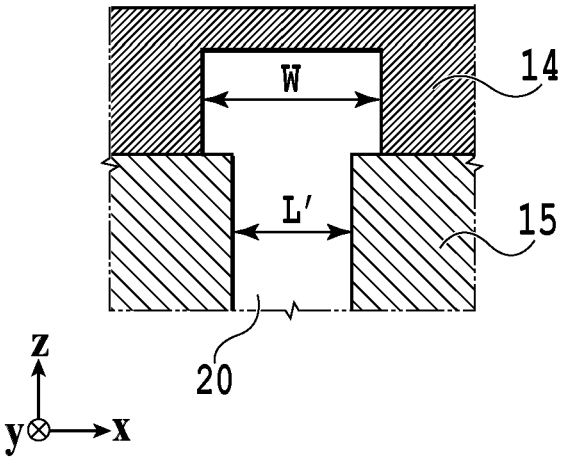
FIG. 15B is a cross-sectional view taken along the XVB-XVB line in FIG. 15A.
Figure 15C:
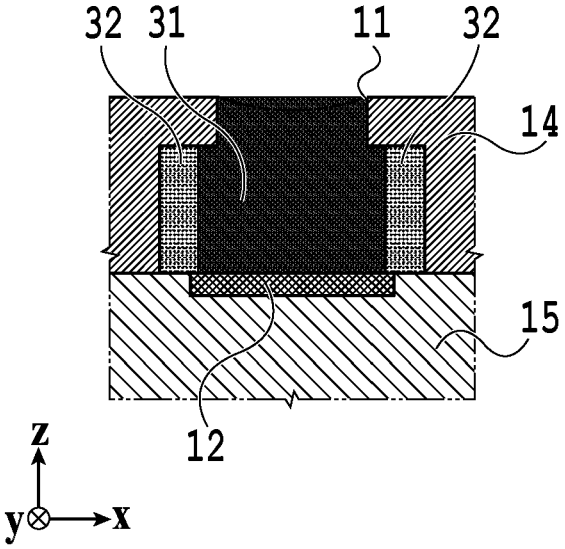
FIG. 15C is a cross-sectional view taken along the XVC-XVC line in FIG. 15A.

On the other hand, FIG. 15A is a top plan view of the first inflow port 20 section of a comparative example, FIG. 15B is a cross-sectional view taken along the XVB-XVB line in FIG. 15A, and FIG. 15C is a cross-sectional view taken along the XVC-XVC line in FIG. 15A. In this comparative example, the length of the first inflow port 20 in the direction orthogonal to the direction of flow of the liquid in the pressure chamber and the direction of ejection of the liquid from the ejection port will be defined as L'. Meanwhile, the length (the width) of the liquid flow passage above the first inflow port will be defined as W. In this case, L'<W holds true. Accordingly, the first liquid 31 flows from the first inflow port 20 into a limited region at the center in the width direction of the liquid flow passage 13, and the second liquid 32 flows along the right and left wall surfaces of the liquid flow passage 13 as shown in FIG. 15C. In other words, interfaces between the first liquid 31 and the second liquid 32 are formed along the width direction of the liquid flow passage 13. Specifically, the first liquid 31 and the second liquid 32 do not form parallel flows stacked in the height direction of the liquid flow passage 13, but the first liquid flows in the pressure chamber in such a way as to be located on the pressure generation element 12 side and the ejection port 11 side, respectively. Since the first liquid 31 is located on the ejection port 11 side in FIG. 15C, it is difficult to mainly eject the second liquid 32.

As described above, a shape of a junction part of the first liquid 31 and the second liquid 32 (a shape of the first inflow port 20 relative to the flow passage above the first inflow port 20) has a large effect on the formation of the interface. In the following, the effect of the shape of the junction part on the formation of the interface will be described further in detail.

Figure 16A:
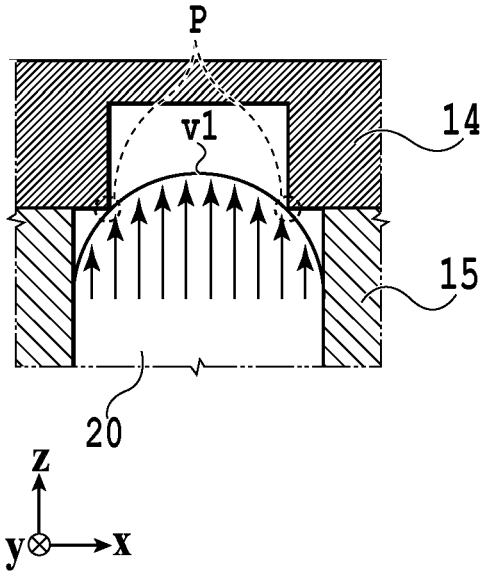
FIG. 16A is an explanatory diagram of a velocity vector of a first liquid in the first embodiment.
Figure 16B:
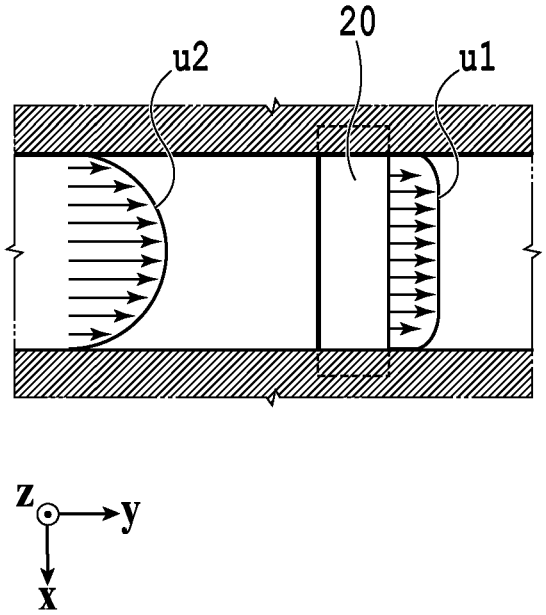
FIG. 16B is an explanatory diagram of velocity distributions of first and second liquids in the first embodiment.

FIG. 16A is an explanatory diagram of a velocity vector v1 of the first liquid 31 on a cross-section similar to that of FIG. 14B. The vector v1 has a distribution in which the velocity at each wall surface of the inflow port 20 is zero while the velocity becomes largest at a central part of the inflow port 20. The first liquid 31 having the aforementioned velocity distribution flows into the liquid flow passage 13 while changing the direction of the flow. Accordingly, the velocity distribution of the first liquid 31 at a portion through which the first liquid 31 flows into the liquid flow passage 13 becomes more uniform as a difference between the velocity at a point P in FIG. 16A representing a position of each wall surface of the liquid flow passage 13 and the velocity at the central part of the liquid flow passage 13 is smaller. FIG. 16B is an explanatory diagram of a velocity distribution u1 of the first liquid 31 at an initial stage which flows from the inflow port 20 into the liquid flow passage 13, and a velocity distribution u2 of the second liquid 32 flowing in the liquid flow passage 13. The second liquid 32 is less likely to enter between the first liquid 31 and the wall surfaces of the liquid flow passage 13 as the velocity distribution v1 and the velocity distribution u1 are more uniform, whereby the second liquid 32 is more likely to flow in a manner that the second liquid 32 is stacked on the first liquid 31 in the height direction of the liquid flow passage 13 as shown in FIG. 14C. However, depending on the physical properties and the flow velocities of the first and second liquids, the formation of the interface as shown in FIG. 14C becomes more difficult as the velocity distributions v1 and u1 are less uniform even though L>W holds true.

As a consequence, it is preferable to set the length L larger than the length (the width) W so as to set the shape of the inflow port 20 and the velocity distributions v1 and u1 as uniform as possible. For example, regarding the shape of the inflow port 20, the velocity distribution v1 in the inflow port 20 becomes more uniform as an aspect ratio determined based on the length L as a long side is larger, and the velocity distribution u1 of the flow out to the liquid flow passage 13 also becomes more uniform likewise.

Figure 16C:
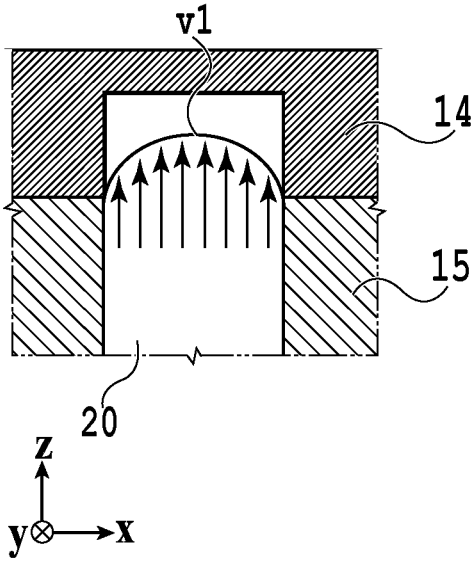
FIG. 16C is an explanatory diagram of a velocity vector of the first liquid in a comparative example.
Figure 16D:
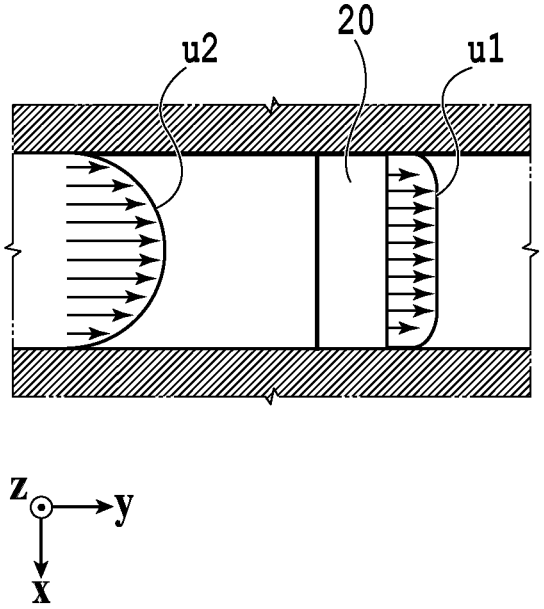
FIG. 16D is an explanatory diagram of velocity distributions of the first and second liquids in the comparative example.

FIGS. 16C and 16D are explanatory diagrams in the case where the length L is equal to the length (the width) W (L=W). In this example, the two end portions of the inflow port 20 linearly extending in the width direction of the liquid flow passage 13 are located at the same positions as the corresponding wall surfaces of the liquid flow passage 13. As shown in FIG. 16D, there are no portions between the wall surfaces of the liquid flow passage 13 and the inflow port 20 where the flow of the first liquid 31 is not generated. Accordingly, the first liquid 31 can flow in the region across the entire width of the liquid flow passage 13 so that the interface like the one in FIG. 14C can be formed. However, the velocity of the velocity vector u1 becomes zero at each wall surface. Accordingly, if the second liquid 32 flows on the wall surface side, interfaces as shown in FIG. 15C may be formed depending on conditions of the physical properties, the flow velocities, and the like. Therefore, in order to form the parallel flows of the first liquid 31 and the second liquid 32 in the height direction of the liquid flow passage 13 as shown in FIG. 14C, it is preferable to satisfy L>W.

Figure 17A:
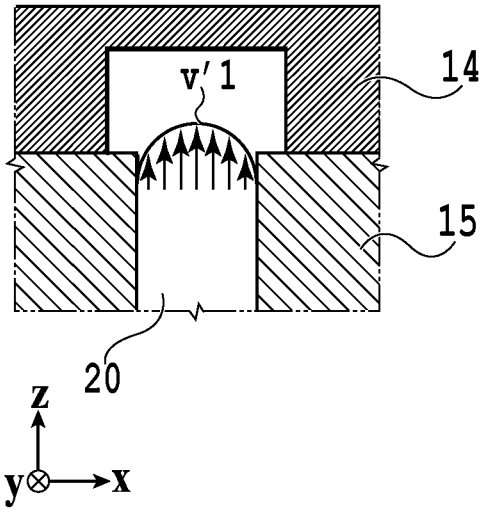
FIG. 17A is an explanatory diagram of a velocity vector of the first liquid in the comparative example shown in FIGS. 15A to 15C.
Figure 17B:
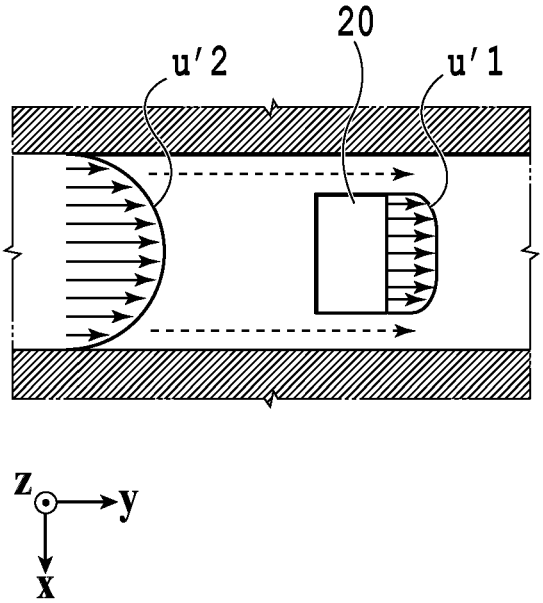
FIG. 17B is an explanatory diagram of velocity distributions of the first and second liquids in the comparative example shown in FIGS. 15A to 15C.

FIG. 17A is an explanatory diagram of a velocity vector v'1 of the first liquid 31 on a cross-section similar to that in a comparative example of FIG. 15B. The vector v'1 has a distribution in which the velocity at each wall surface of the inflow port 20 is zero while the velocity becomes largest at a central part of the inflow port 20. FIG. 17B is an explanatory diagram of a velocity distribution u'1 of the first liquid 31 at an initial stage which flows from the inflow port 20 into the liquid flow passage 13 and a velocity distribution u'2 of the second liquid 32 flowing in the liquid flow passage 13. Since L'<W holds true in this comparative example, there may be portions between the wall surfaces of the liquid flow passage 13 and the inflow port 20, where the flow of the first liquid 31 is less likely to be generated as shown in FIG. 17B even though the velocity distribution v'1 is nearly uniform. The second liquid 32 enters between the wall surfaces of the liquid flow passage 13 and the inflow port 20 as indicated with arrows in dotted lines in FIG. 17B, and consequently flows between the first liquid 31 and the wall surfaces of the liquid flow passage 13 as shown in FIG. 15C.

The comparative example has been described above by using the example in which the first liquid 31 and the second liquid 32 are not stacked in the height direction in the case where L'<W holds true. However, there may also be a case where the first liquid and the second liquid are formed into the parallel flows stacked in the height direction depending on the flow rates and viscosities thereof even in the case where L'<W holds true. Nonetheless, it is preferable to satisfy L≥W as mentioned above in order to allow the first liquid and the second liquid to flow stably while being stacked in the height direction.

(Shape of Inflow Port and Flow Rates)

Figure 18A:
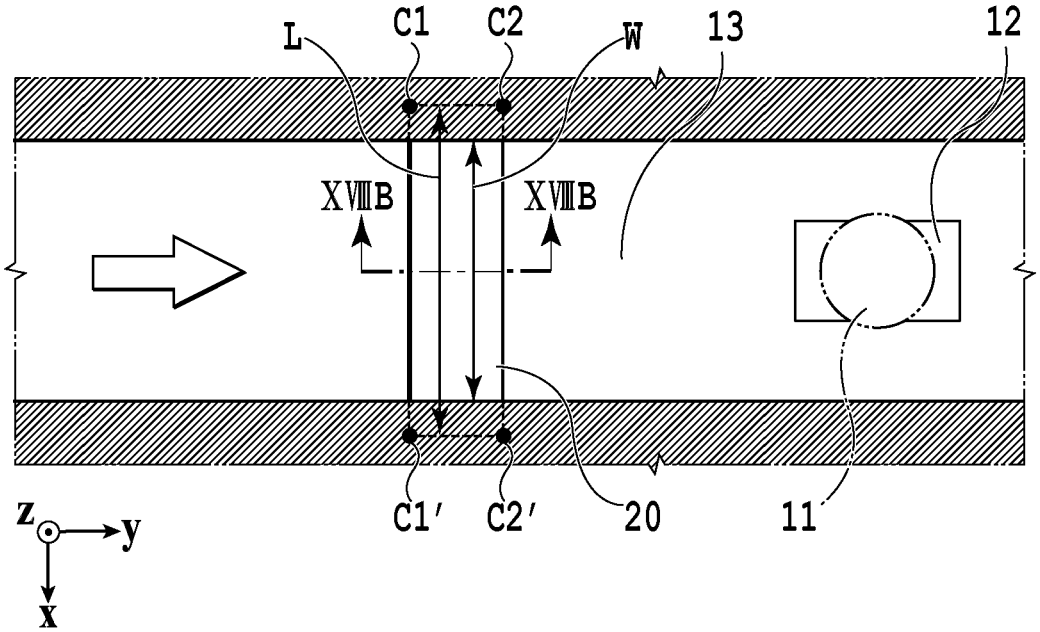
FIG. 18A is a top plan view of the first inflow port section of the first embodiment.
Figure 18B:
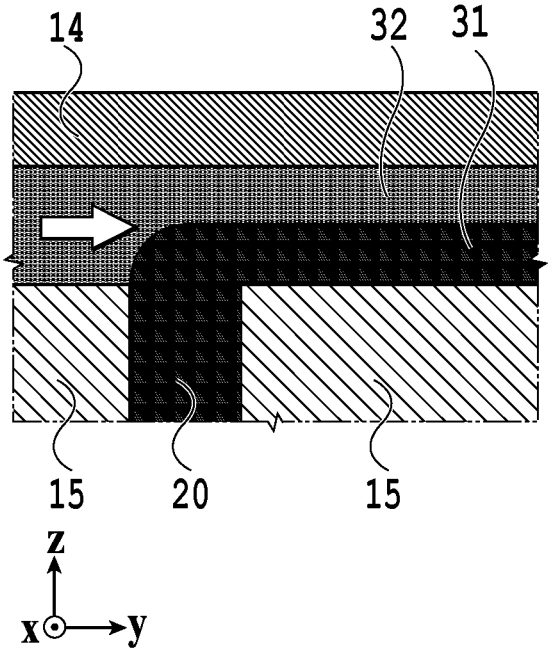
FIGS. 18B and 18C are explanatory diagrams showing cases where layer thicknesses of the first and second liquids are different in terms of a cross-section taken along the XVIIIB-XVIIIB line in FIG. 18A, respectively.

Next, a description will be given of relations between the length L (≥W) of the first inflow port 20 and a flow rate $Q_1$ of the first liquid 31 and a flow rate $Q_2$ of the second liquid 32 in this embodiment. FIG. 18A is a top plan view of the first inflow port 20 section of this embodiment, and FIG. 18B is a cross-sectional view taken along the XVIIIB-XVIIIB line in FIG. 18A.

In the case where the viscosities of the first liquid 31 and the second liquid 32 are nearly equal and the flow rates thereof satisfy $Q_1 \geq Q_2$, a sufficient amount of the first liquid flows from the inflow port 20 into the liquid flow passage. At a position on an upstream side in the y direction of the inflow port 20, the first liquid and the second liquid join together. Accordingly, the shape of the interface therebetween is largely influenced by the shape on the upstream side in the y direction of the inflow port 20. For this reason, it is preferable to set at least a length of a side portion (a first side portion; a side portion between a point C1 and a point C1') of the inflow port 20 located on the most upstream side in the y direction larger than the length (the width) W of the liquid flow passage 13 as shown in FIG. 18A. In this way, it is possible to keep the second liquid from entering between the first liquid and the wall surfaces of the liquid flow passage 13 at a junction point of the first liquid and the second liquid and thus to form the horizontal interface therebetween as shown in FIG. 18B.

Figure 18C:
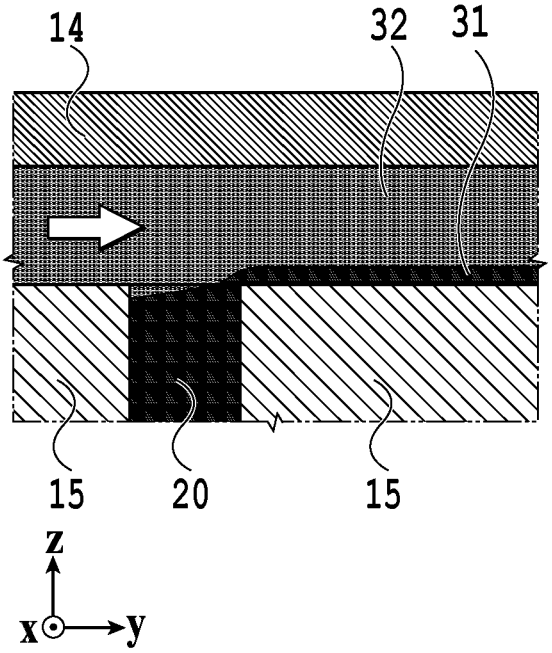

On the other hand, in the case where the viscosities of the first liquid 31 and the second liquid 32 are nearly equal and the flow rates thereof satisfy $Q_1 < Q_2$, the first liquid flows from the inflow port 20 into the liquid flow passage 13 as shown in FIG. 18C. In this instance, since the flow rate $Q_2$ of the second liquid is large, the second liquid nearly squashes the first liquid above the inflow port 20. In other words, the first liquid is almost in the state of flowing into the liquid flow passage 13 from a downstream side in the y direction of the inflow port 20, whereby the junction point of the first liquid and the second liquid in the liquid flow passage 13 is located at a position on the downstream side in the y direction of the inflow port 20. Accordingly, the shape of the interface between the liquids is largely influenced by a shape on the downstream side in the y direction of the inflow port 20. For this reason, it is preferable to set at least a length of a side portion (a second side portion; a side portion between a point C2 and a point C2') of the inflow port 20 located on the most downstream side in the y direction larger than the length (the width) W of the liquid flow passage 13. In this way, it is possible to keep the second liquid from entering between the first liquid and the wall surfaces of the liquid flow passage 13 at the junction point of the first liquid and the second liquid, and thus to form the horizontal interface therebetween as shown in FIG. 18C. In the case of mainly ejecting the second liquid by bubbling the first liquid, for example, the flow rates of these liquids may be set to satisfy $Q_1 < Q_2$ such that a layer thickness of the first liquid becomes smaller than a layer thickness of the second liquid. In this case, it is preferable to set at least the length of the second side portion of the inflow port 20 located on the downstream side in the y direction larger than the length (the width) W of the liquid flow passage 13.

In the example of FIG. 18A, the lengths (L for both) of the first side portion and the second side portion located on the upstream side and the downstream side in the y direction are larger than the length (the width) W of the liquid flow passage 13, and the two side portions of each of the side portions are located outside the corresponding wall surfaces of the liquid flow passage 13.

(Modified Examples of Inflow Port)

The first inflow port 20 only needs to have a portion that satisfies L≥W as mentioned above and does not always have to extend linearly in the width direction of the liquid flow passage 13. In the meantime, the first inflow port 20 does not always have to satisfy L≥W at the entire portion of the first inflow port 20.

Figure 19A:
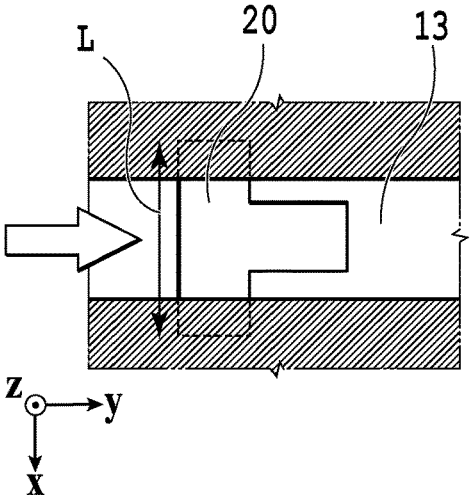
FIGS. 19A to 19E are explanatory diagrams of various modified examples of the first inflow port of the first embodiment, respectively.
Figure 19B:
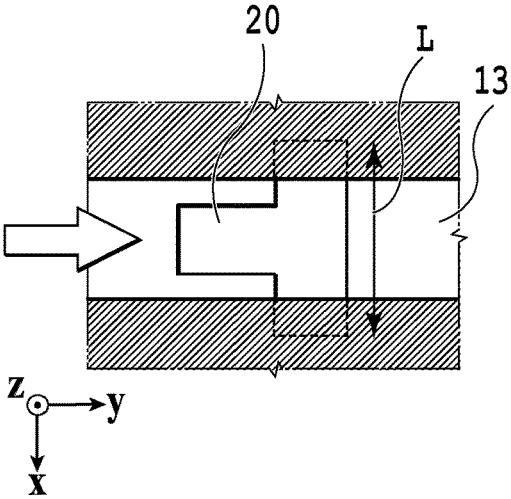
Figure 19C:
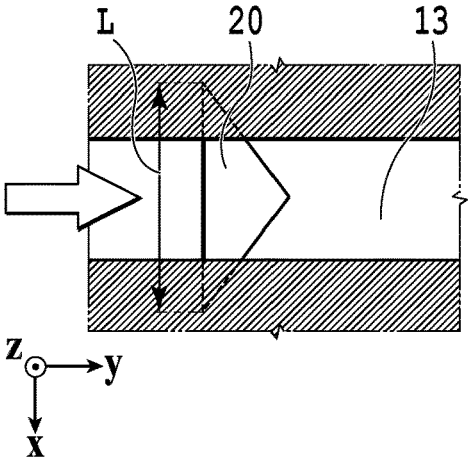
Figure 19D:
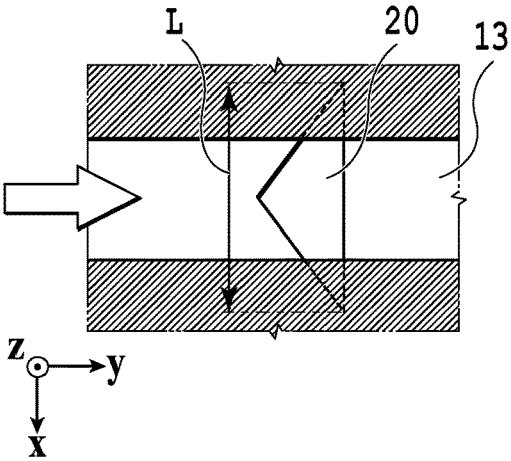
Figure 19E:
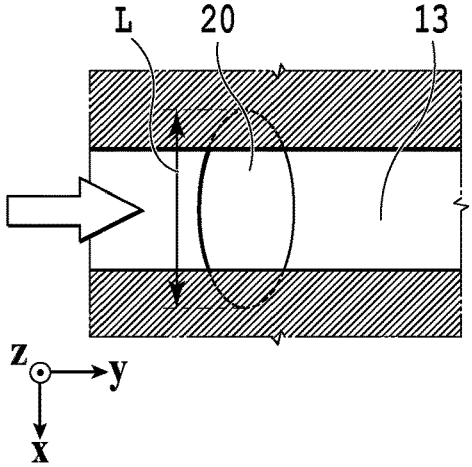

FIGS. 19A and 19B are explanatory diagrams of various modified examples of the first inflow port 20. The inflow port 20 in FIG. 19A has a flat surface shape which projects to the downstream side in the y direction while the inflow port 20 in FIG. 19B has a flat surface shape which projects to the upstream side in the y direction. FIGS. 19C and 19D are explanatory diagrams of other modified examples in which the projecting parts in the flat surface shapes of the inflow ports 20 in FIGS. 19A and 19B are changed to triangular shapes. In the case where the flow rates of the first and second liquids satisfy $Q_1 \geq Q_2$, the shapes in FIGS. 19A and 19C in which the first side portion of the inflow port 20 located on the upstream side in the y direction is larger than the length (the width) W are preferred as described previously. On the other hand, in the case where the flow rates thereof satisfy $Q_1 < Q_2$, the shapes in FIGS. 19B and 19D in which the second side portion of the inflow port 20 located on the downstream side in the y direction is larger than the length (the width) W are preferred as described previously. In the meantime, the first side portion on the upstream side and/or the second side portion on the downstream side in the y direction of the inflow port 20 do not always have to be straight. For example, the side portions may be formed into curves as shown in FIG. 19E.

Figure 20A:
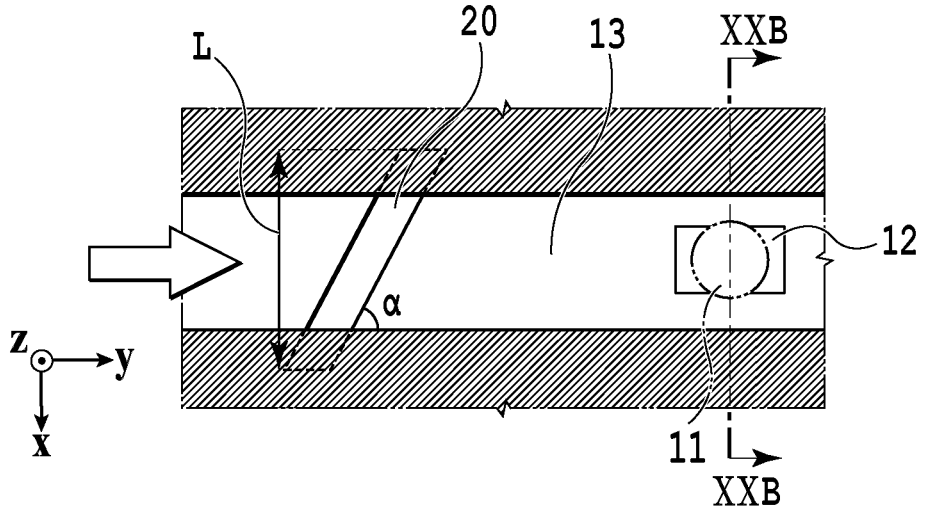
FIG. 20A is an explanatory diagram of still another modified example of the first inflow port of the first embodiment.
Figure 20B:
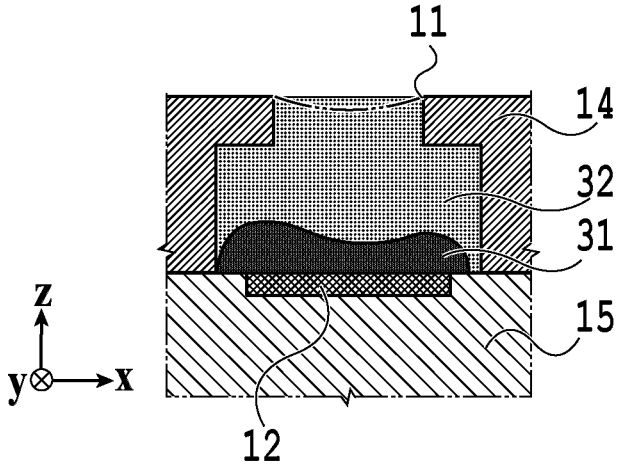
FIG. 20B is a cross-sectional view taken along the XXB-XXB line in FIG. 20A.

Alternatively, the inflow port 20 may be formed into such a shape that the side portions of the inflow port 20 extend so as to form a certain angle $\alpha$ ($\alpha \approx 90°$) relative to the direction of extension of the liquid flow passage 13 (the y direction) as shown in FIG. 20A. Even in the case where the side portions have the given angle $\alpha$, the liquid flow passage 13 can keep the second liquid from entering between the first liquid and the wall surfaces of the liquid flow passage and can form the horizontal interface therebetween, since the length L in the width direction of the liquid flow passage 13 is equal to or above the length (the width) W of the liquid flow passage 13. It is to be noted, however, that the second liquid may enter between the first liquid and the wall surfaces of the liquid flow passage 13 in the case where the flow rates satisfy $Q_1 < Q_2$ and the first liquid mainly flows into the liquid flow passage 13 from the downstream side in the y direction of the inflow port 20 as described earlier. FIG. 20B is a cross-sectional view taken along the XXB-XXB line in FIG. 20A, which shows the case where the aforementioned phenomenon takes place. As shown in FIG. 20B, the second liquid is prone to enter the upstream side in the y direction of the inflow port 20 and at least one end side out of the right and left sides of the liquid flow passage 13 in FIG. 20B may be occupied by the second liquid. In the meantime, along with the flow velocity distribution of the first liquid, the interface may fail to form the horizontal shape but is formed into such a shape corresponding to the flow velocity distribution. However, even if the interface has this shape, it is still possible to eject the second liquid mainly from the ejection port 11 since the first liquid is mainly located on the pressure generation element 12 side and the second liquid is located on the ejection port 11 side.

Second Embodiment

This embodiment also uses the liquid ejection head 1 and the liquid ejection apparatus shown in FIGS. 1 to 3.

Figure 21A:
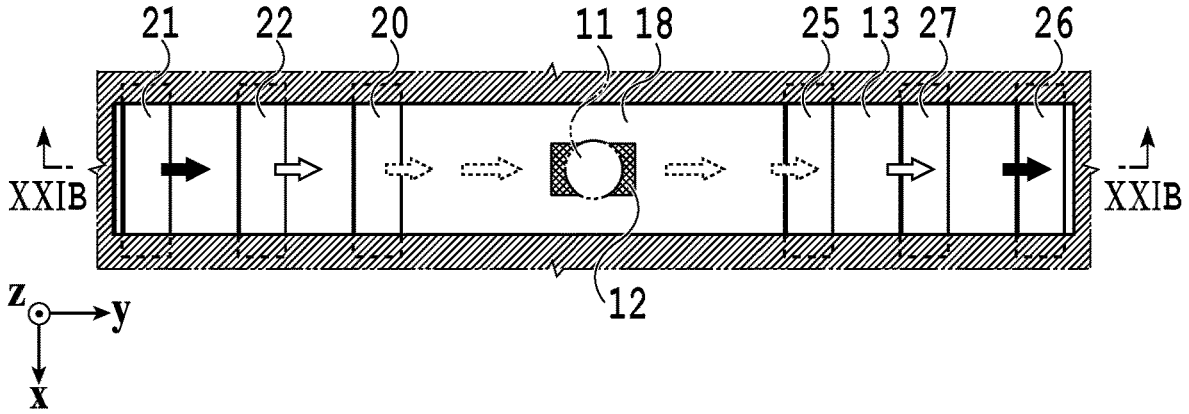
FIG. 21A is a transparent view of a liquid flow passage in a second embodiment.
Figure 21B:
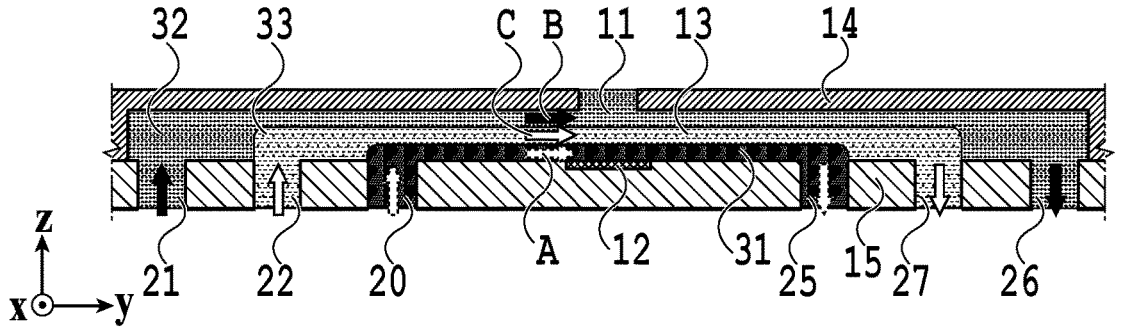
FIG. 21B is a cross-sectional view taken along the XXIB-XXIB line in FIG. 21A.
Figure 21C:
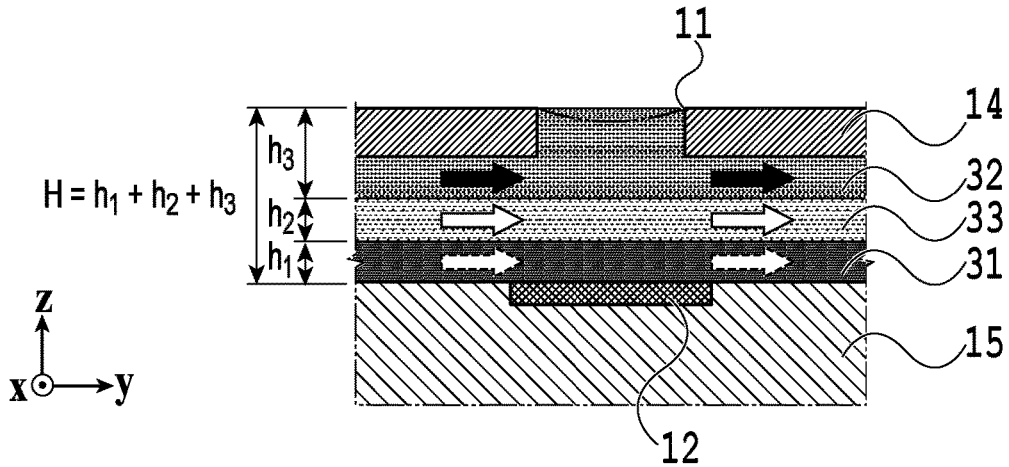
FIG. 21C is an enlarged diagram of an ejection port section in FIG. 21B.

FIGS. 21A to 21C are diagrams showing a configuration of the liquid flow passage 13 of this embodiment. The liquid flow passage 13 of this embodiment is different from the liquid flow passage 13 described in the first embodiment. In this embodiment, a third liquid 33 is allowed to flow in the liquid flow passage 13 in addition to the first liquid 31 and the second liquid 32. By allowing the third liquid 33 to flow in the pressure chamber, it is possible to use the bubbling medium with the high critical pressure as the first liquid while using any of the inks of different colors, the high-density resin EM, and the like as the second liquid and the third liquid.

In the liquid flow passage 13 of this embodiment, the third liquid 33 can also form a parallel flow in state of laminar flow in addition to the parallel flows in the state of laminar flow by the first liquid 31 and the second liquid 32 in the above-described first embodiment as shown in FIGS. 21B and 21C. In the upper surface of the silicon substrate 15 corresponding to the inner surface (bottom portion) of the liquid flow passage 13, the second inflow port 21, a third inflow port 22, the first inflow port 20, the first outflow port 25, a third outflow port 27, and the second outflow port 26 are formed in this order in the y direction. The pressure chamber 18 including the ejection port 11 and the pressure generation element 12 is located substantially at the center between the first inflow port 20 and the first outflow port 25 in the liquid flow passage 13.

As with the above-described embodiment, the first liquid 31 and the second liquid 32 flow from the first and second inflow ports 20 and 21 into the liquid flow passage 13, then flow in the y direction through the pressure chamber 18, and then flow out of the first and second outflow ports 25 and 26. The third liquid 33 flows from the third inflow port 22 into the liquid flow passage 13, then flows in a direction of an arrow C in the liquid flow passage 13 through the pressure chamber 18, and then flows out of the third outflow port 27. As a consequence, in the liquid flow passage 13, the first liquid 31, the second liquid 32, and the third liquid 33 flow together in the y direction between the first inflow port 20 and the first outflow port 25. In this instance, the first liquid 31 is in contact with the inner surface of the pressure chamber 18 (an upper surface 15A of the silicon substrate 15) where the pressure generation element 12 is located. Meanwhile, the second liquid 32 forms the meniscus at the ejection port 11 and the third liquid 33 flows between the first liquid 31 and the second liquid 32.

In this embodiment, the length of the first inflow port 20 in the width direction of the liquid flow passage 13 is set equal to or above the width of the liquid flow passage 13 and the length of the second inflow port 21 in the width direction of the liquid flow passage 13 is also set equal to or above the width of the liquid flow passage 13 as with the above-described first embodiment. At least the length L of each of the first and second inflow ports 20 and 21 needs to be equal to or above the length (the width) W ($L \geq W$). In this way, by forming the second inflow port 21 as with the first inflow port 20, the second liquid 32 flows into the entire region in the width direction of the liquid flow passage 13, so that the respective interfaces between the first liquid 31, the second liquid 32, and the third liquid 33 can be formed horizontally as a consequence.

In this embodiment, the CPU 500 controls the flow rate $Q_1$ of the first liquid 31, the flow rate $Q_2$ of the second liquid 32, and a flow rate $Q_3$ of the third liquid 33 by using the liquid circulation unit 504, and causes the three liquids to form three-layered parallel flows steadily as shown in FIG. 21C. Then, in the state where the three-layered parallel flows are formed as described above, the CPU 500 drives the pressure generation element 12 of the liquid ejection head 1 and ejects the droplet from the ejection port 11. Even if the position of each interface is disturbed along with the ejection operation described above, the three-layered parallel flows of the three liquids are recovered in a short time so that the next ejection operation can be started right away. As a consequence, it is possible to execute the good ejection operation of the droplet containing the first, second, and third liquids at the predetermined ratio and to obtain a fine output product with their droplets deposited.

Other Embodiments

The first liquid and the second liquids flowing in the pressure chamber may be circulated between the pressure chamber and an outside unit. If the circulation is not conducted, a large amount of any of the first liquid and the second liquid having formed the parallel flows in the liquid flow passage and the pressure chamber but having not been ejected would remain inside. Accordingly, the circulation of the first liquid and the second liquid with the outside unit makes it possible to use the liquids that have not been ejected in order to form the parallel flows again.

The liquid ejection head and the liquid ejection apparatus in the embodiments are not limited only to the inkjet printing head and the inkjet printing apparatus configured to eject an ink. The liquid ejection head and the liquid ejection apparatus in the embodiments are applicable to various apparatuses including a printer, a copier, a facsimile equipped with a telecommunication system, and a word processor including a printer unit, and to other industrial printing apparatuses that are integrally combined with various processing apparatuses. In particular, since various liquids can be used as the second liquid, the liquid ejection head and the liquid ejection apparatus are also adaptable to other applications including biochip fabrication, electronic circuit printing, and so forth.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-143894, filed Jul. 31, 2018, and No. 2019-079683 filed Apr. 18, 2019 which are hereby incorporated by reference herein in their entirety.

What is claimed is:

1. A liquid ejection head comprising:

a substrate;

a liquid flow passage formed on the substrate and configured to allow a first liquid and a second liquid to flow inside, the liquid flow passage including a pressure chamber;

a pressure generation element configured to apply pressure to the first liquid in the pressure chamber; and an ejection port configured to eject the second liquid, wherein the substrate includes a first inflow port configured to allow the first liquid to flow into the liquid flow passage in a direction crossing the liquid flow passage, and a second inflow port configured to allow the second liquid to flow into the liquid flow passage, the first inflow port is located at a position closer to the pressure chamber than the second inflow port is, the first liquid and the second liquid flowing into the liquid flow passage flow in the liquid flow passage toward the pressure chamber, in a case where a dimension of the first inflow port is defined as L and a dimension of the liquid flow passage above the first inflow port is defined as W, in a direction orthogonal to a direction of flow of the first liquid in the pressure chamber and to a direction of ejection of the second liquid from the ejection port, the liquid ejection head includes a portion that satisfies a relation defined as $L \geq W$, and in a case where the direction of ejection of the second liquid is a direction from bottom to top, the second liquid flows above the first liquid.

2. The liquid ejection head according to claim 1, wherein the first liquid and the second liquid form laminar flows in the pressure chamber.

3. The liquid ejection head according to claim 1, wherein the first liquid and the second liquid form parallel flows in the pressure chamber.

4. The liquid ejection head according to claim 1, wherein in the direction orthogonal to the direction of flow of the first liquid in the pressure chamber and to the direction of ejection of the second liquid from the ejection port, (i) two end portions of the first inflow port are located at the same positions as wall surfaces of the liquid flow passage above the first inflow port, (ii) the two end portions of the first inflow port are located outside the wall surfaces of the liquid flow passage above the first inflow port, or (iii) one of the two end portions of the first inflow port is located at the same position as the corresponding wall surface of the liquid flow passage above the first inflow port and the other end portion of the first inflow port is located outside the other corresponding wall surface of the liquid flow passage above the first inflow port.

5. The liquid ejection head according to claim 3, wherein in the direction orthogonal to the direction of flow of the first liquid in the pressure chamber and to the direction of ejection of the second liquid from the ejection port, (i) two end portions of the first inflow port are located at the same positions as wall surfaces of the liquid flow passage above the first inflow port, (ii) the two end portions of the first inflow port are located outside the wall surfaces of the liquid flow passage above the first inflow port, or (iii) one of the two end portions is located at the same position as the corresponding wall surface of the liquid flow passage above the first inflow port and the other end portion is located outside the other corresponding wall surface of the liquid flow passage above the first inflow port.

6. The liquid ejection head according to claim 1, wherein the first inflow port extends in a direction orthogonal to the direction of flow of the first liquid.

7. The liquid ejection head according to claim 1, wherein the liquid ejection head includes a portion satisfying a relation defined as $L>W$ regarding the dimension L and the dimension W.

8. The liquid ejection head according to claim 1, wherein in a case where a flow rate of the first liquid is $Q_1$ and a flow rate of the second liquid is $Q_2$, the flow rates satisfy a relation defined as $Q_1 \leq Q_2$, the first inflow port includes a first side portion located on an upstream side in the direction of flow of the first liquid and a second side portion located on a downstream side in the direction of flow of the first liquid, and at least the second side portion out of the first and second side portions satisfies the relation defined as $L \geq W$.

9. The liquid ejection head according to claim 1, wherein in a case where a flow rate of the first liquid is $Q_1$ and a flow rate of the second liquid is $Q_2$, the flow rates satisfy a relation defined as $Q_1 > Q_2$, the first inflow port includes a first side portion located on an upstream side in the direction of flow of the first liquid and a second side portion located on a downstream side in the direction of flow of the first liquid, and at least the first side portion out of the first and second side portions satisfies the relation defined as $L \geq W$.

10. The liquid ejection head according to claim 8, wherein at least one of the first side portion and the second side portion is straight.

11. The liquid ejection head according to claim 1, wherein the pressure generation element and the ejection port are opposed to each other with the pressure chamber interposed in between.

12. The liquid ejection head according to claim 3, wherein the pressure generation element and the ejection port are opposed to each other with the pressure chamber interposed in between.

13. The liquid ejection head according to claim 11, wherein the pressure chamber satisfies the following relation:

$$h_1/(h_1+h_2) \leq -0.1390+0.0155H,$$

where H [μm] is a height of the pressure chamber, $h_1$ is a phase thickness of the first liquid, and $h_2$ is a phase thickness of the second liquid.

14. The liquid ejection head according to claim 12, wherein the pressure chamber satisfies the following relation:

$$h_1/(h_1+h_2) \leq -0.1390+0.0155H,$$

where H [μm] is a height of the pressure chamber, $h_1$ is a phase thickness of the first liquid, and $h_2$ is a phase thickness of the second liquid.

15. The liquid ejection head according to claim 1, wherein the first liquid flowing in the pressure chamber is circulated between the pressure chamber and an outside unit.

16. The liquid ejection head according to claim 1, wherein an interface on which the first liquid and the second liquid are in contact with each other is formed at a position between the ejection port and the pressure generation element.

17. The liquid ejection head according to claim 1, further comprising:

a first outflow port configured to allow the first liquid to flow out of the pressure chamber; and a second outflow port configured to allow the second liquid to flow out of the pressure chamber.

18. The liquid ejection head according to claim 15, further comprising:

a first outflow port configured to allow the first liquid to flow out of the pressure chamber; and a second outflow port configured to allow the second liquid to flow out of the pressure chamber.

19. A liquid ejection module for constituting a liquid ejection head, wherein the liquid ejection head includes a substrate, a liquid flow passage formed on the substrate and configured to allow a first liquid and a second liquid to flow inside, the liquid flow passage including a pressure chamber, a pressure generation element configured to apply pressure to the first liquid in the pressure chamber, and an ejection port configured to eject the second liquid, the substrate includes:

a first inflow port configured to allow the first liquid to flow into the liquid flow passage in a direction crossing the liquid flow passage, and a second inflow port configured to allow the second liquid to flow into the liquid flow passage, the first inflow port is located at a position closer to the pressure chamber than the second inflow port is, the first liquid and the second liquid flowing into the liquid flow passage flow in the liquid flow passage toward the pressure chamber, in a case where a dimension of the first inflow port is defined as L and a dimension of the liquid flow passage above the first inflow port is defined as W, in a direction orthogonal to a direction of flow of the first liquid in the pressure chamber and to a direction of ejection of the second liquid from the ejection port, the liquid ejection head includes a portion that satisfies a relation defined as $L \geq W$, in a case where the direction of ejection of the second liquid is a direction from bottom to top, the second liquid flows above the first liquid, and the liquid ejection head is formed by arraying multiple liquid ejection modules.

20. A liquid ejection apparatus comprising a liquid ejection head, the liquid ejection head including:

a substrate, a liquid flow passage formed on the substrate and configured to allow a first liquid and a second liquid to flow inside, the liquid flow passage including a pressure chamber, a pressure generation element configured to apply pressure to the first liquid in the pressure chamber, and an ejection port configured to eject the second liquid, wherein the substrate includes:

a first inflow port configured to allow the first liquid to flow into the liquid flow passage in a direction crossing the liquid flow passage, and a second inflow port configured to allow the second liquid to flow into the liquid flow passage, the first inflow port is located at a position closer to the pressure chamber than the second inflow port is, the first liquid and the second liquid flowing into the liquid flow passage flow in the liquid flow passage toward the pressure chamber, in a case where a dimension of the first inflow port is defined as L and a dimension of the liquid flow passage above the first inflow port is defined as W, in a direction orthogonal to a direction of flow of the first liquid in the pressure chamber and to a direction of ejection of the second liquid from the ejection port, the liquid ejection head includes a portion that satisfies a relation defined as $L \geq W$, and in a case where the direction of ejection of the second liquid is a direction from bottom to top, the second liquid flows above the first liquid.

* * * * *